US010457076B2

(12) United States Patent
Inoue et al.

(10) Patent No.: US 10,457,076 B2
(45) Date of Patent: Oct. 29, 2019

(54) INK JET PRINTING METHOD AND INK JET PRINTING APPARATUS

(71) Applicant: CANON KABUSHIKI KAISHA, Tokyo (JP)

(72) Inventors: Koji Inoue, Tokyo (JP); Noboru Toyama, Kawasaki (JP); Akihiro Mouri, Fuchu (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/021,510

(22) Filed: Jun. 28, 2018

(65) Prior Publication Data

US 2019/0009579 A1 Jan. 10, 2019

(30) Foreign Application Priority Data

Jul. 4, 2017 (JP) ..... 2017-131558

(51) Int. Cl.

| | |
|---|---|
| ***B41J 11/00*** | (2006.01) |
| ***B41J 2/01*** | (2006.01) |
| ***B41J 29/17*** | (2006.01) |
| ***B41J 2/005*** | (2006.01) |

(52) U.S. Cl.

CPC ..... *B41J 11/007* (2013.01); *B41J 2/0057* (2013.01); *B41J 2/01* (2013.01); *B41J 29/17* (2013.01); *B41J 2002/012* (2013.01)

(58) Field of Classification Search

CPC . B41J 11/007; B41J 2/0057; B41J 2/01; B41J 2002/012; B41J 2/165; B41J 2/16538; B41J 2002/16502

See application file for complete search history.

(56) References Cited

U.S. PATENT DOCUMENTS

2006/0232624 A1* 10/2006 Inoue ..... B41J 3/44 347/23
2011/0134200 A1* 6/2011 Ikegami ..... B41J 11/007 347/104
2013/0050332 A1* 2/2013 Aoki ..... B41J 2/2107 347/20
2017/0217191 A1 8/2017 Hirokawa et al.
2017/0217216 A1 8/2017 Ohnishi et al.

(Continued)

FOREIGN PATENT DOCUMENTS

JP 2009-045851 A 3/2009

*Primary Examiner* — Kristal Feggins
(74) *Attorney, Agent, or Firm* — Venable LLP

(57) ABSTRACT

An ink jet printing method includes an ink image forming step of forming an ink image onto an ink receiving medium, a liquid absorbing step of performing liquid absorption treatment in which an aqueous liquid component is at least partially absorbed by a porous body from the ink image, by contacting a liquid absorbing surface of the porous body of a liquid absorbing member with the ink image in a liquid absorption treatment region, and a conveying step of conveying the porous body conveyed from the liquid absorption treatment region to the liquid absorption treatment region again. The method also includes a porous body checking step of forming a test pattern for testing an image quality, detecting the image quality of the test pattern, subjected to the liquid absorbing step, by an image quality detecting device, and determining a state of the porous body from obtained detection results.

21 Claims, 10 Drawing Sheets

(56) References Cited

U.S. PATENT DOCUMENTS

| | | | |
|---|---|---|---|
| 2018/0311951 | A1 | 11/2018 | Sakamoto et al. |
| 2018/0319179 | A1 | 11/2018 | Yamane et al. |
| 2018/0326719 | A1 | 11/2018 | Masuda et al. |
| 2018/0326755 | A1 | 11/2018 | Ohnishi et al. |

* cited by examiner

INK JET PRINTING METHOD AND INK JET PRINTING APPARATUS

BACKGROUND OF THE INVENTION

Field of the Invention

The present invention relates to an ink jet printing method and an ink jet printing apparatus using liquid absorption treatment of absorbing a liquid component from an image.

Description of the Related Art

In an ink jet printing method, an image is formed by directly or indirectly applying a liquid composition (ink) containing a coloring material onto a printing medium such as paper. Here, curl or cockling may occur due to excessive absorption of a liquid component in the ink by the printing medium.

Therefore, in order to rapidly remove a liquid component in ink, there is a method of drying a printing medium using a unit such as warm air or infrared rays or a method of transferring an image onto a printing medium such as paper after forming an image on a transfer body and drying a liquid component contained in an image on the transfer body using heat energy, etc.

Further, as a unit of removing a liquid component contained in an image on a transfer body, a method of contacting a porous body having a roller shape with an ink image to absorb and remove the liquid component from the ink image without using heat energy has been suggested (Japanese Patent Application Laid-Open No. 2009-45851).

Since a relatively large amount of liquid component is contained in the ink image formed by the ink before the liquid component is removed therefrom, the ink image is soft and is easily deformed by external force. Further, at the time of removing the liquid component, the liquid component in the ink image is decreased, such that the ink image becomes hard and thus the ink image is hard to be deformed by external force.

As disclosed in Japanese Patent Application Laid-Open No. 2009-45851, in the case of repeatedly using a porous body of a liquid absorbing member at the time of removing a liquid from an ink image, the porous body is slowly compressed and deformed by a contact pressure at the time of removing the liquid, such that liquid absorption properties may be deteriorated. In order to smoothly remove the liquid component from the ink image, it is important to allow the liquid to be absorbed by the porous body while suppressing deformation of the ink image. It could be appreciated that when the liquid absorption properties of the porous body are deteriorated, a phenomenon (hereinafter, referred to as a smeared image) that a flow resistance of the liquid component flowing into the porous body is increased, and the liquid component in the ink image is swept away toward a rear end side of the ink image by a pressing pressure caused by the liquid absorbing member occurs.

The present invention has been made based on the background described above. An object of the present invention is to provide an ink jet printing method and an ink jet printing apparatus capable of determining a change in a state of a porous body to perform suitable processing depending on the state of the porous body even in the case of repeatedly using the porous body in absorbing a liquid component from a reaction liquid for thickening ink and an image by the ink.

SUMMARY OF THE INVENTION

An ink jet printing method according to an embodiment of the present invention includes:

an ink image forming step of forming an ink image containing an aqueous liquid component and a coloring material by applying a reaction liquid for thickening ink and ink containing an aqueous liquid medium and the coloring material onto an ink receiving medium;

a liquid absorbing step of performing liquid absorption treatment in which the aqueous liquid component is at least partially absorbed by a porous body from the ink image by contacting a liquid absorbing surface of the porous body of a liquid absorbing member with the ink image in a liquid absorption treatment region; and a conveying step of conveying the porous body conveyed from the liquid absorption treatment region to the liquid absorption treatment region again, wherein the ink jet printing method further includes a porous body checking step of forming a test pattern for testing image quality, detecting image quality of the test pattern subjected to the liquid absorbing step by an image quality detecting device, and determining a state of the porous body from obtained detection results.

Further features of the present invention will become apparent from the following description of exemplary embodiments with reference to the attached drawings.

DESCRIPTION OF THE EMBODIMENTS

Figure 1:
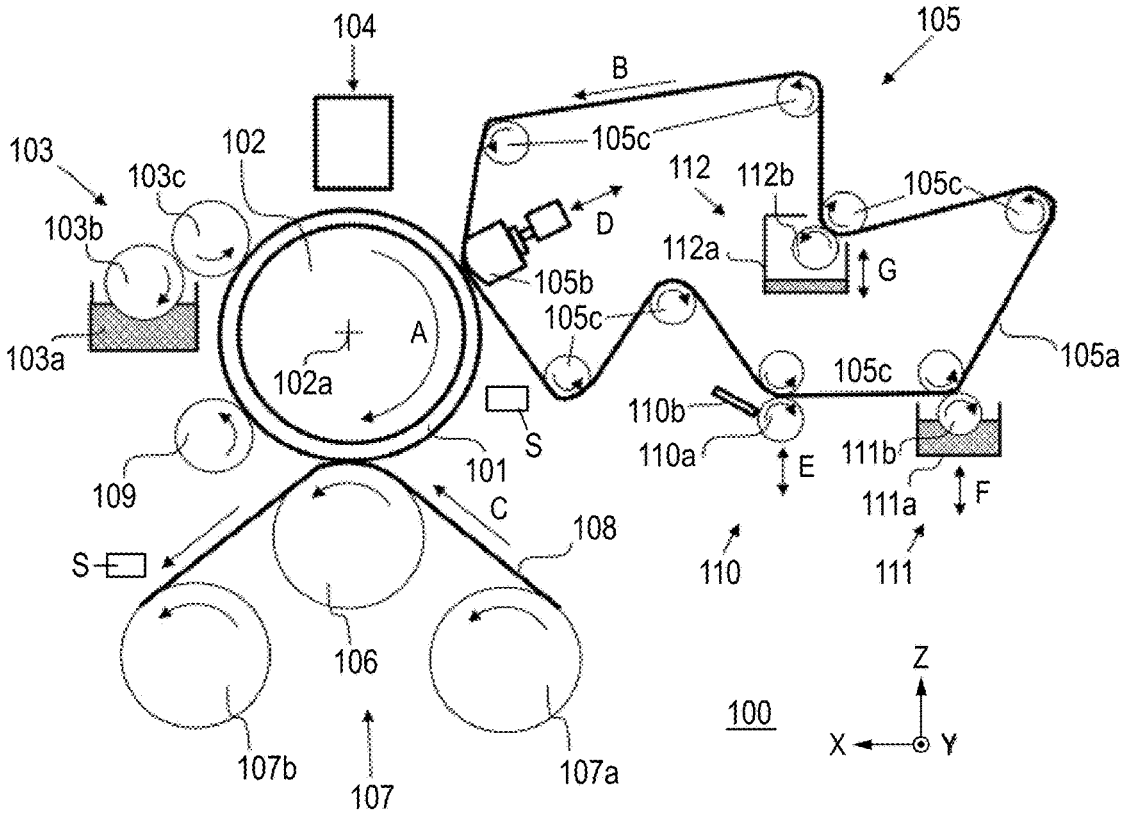
FIG. 1 is a schematic diagram illustrating an example of a configuration of a transfer type ink jet printing apparatus according to an exemplary embodiment of the present invention.

An ink jet printing method according to the present invention has the following steps:

(A) an image forming step of forming an image containing an aqueous liquid component and a coloring material by applying a reaction liquid for thickening ink and ink containing an aqueous liquid medium and the coloring material onto an ink receiving medium (printing medium);

(B) a liquid absorbing step of performing liquid absorption treatment in which the aqueous liquid component is at least partially absorbed by a porous body from the image by contacting a liquid absorbing surface of the porous body of a liquid absorbing member with the image in a liquid absorption treatment region;

(C) a conveying step of conveying the porous body conveyed from the liquid absorption treatment region to the liquid absorption treatment region again; and (D) a porous body checking step of forming a test pattern for testing image quality as the image, detecting image quality of the test pattern subjected to the liquid absorbing step by an image quality detecting device, and determining a state of the porous body from obtained detection results.

An ink jet printing apparatus according to the present invention has the following devices and units:

(1) an ink image forming unit applying a reaction liquid for thickening ink and ink containing an aqueous liquid medium and a coloring material onto an ink receiving medium to form an image containing an aqueous liquid component and the coloring material;

(2) a liquid absorbing device including a liquid absorbing member having a porous body at least partially absorbing the aqueous liquid component from the image through a liquid absorbing surface thereof coming in contact with the image in a liquid absorption treatment region;

(3) a conveyance device conveying the porous body conveyed from a liquid absorption treatment region to the liquid absorption treatment region again;

(4) a device operation controller controlling operations of the image forming unit, the liquid absorbing device and the conveyance device; and (5) an image quality detecting device detecting image quality of the image subjected to the liquid absorption treatment in the liquid absorbing device and a porous body state determining unit instructing the device operation controller to form a test pattern for checking image quality and the image quality detecting device to detect image quality of the test pattern subjected to liquid absorption treatment in the liquid absorbing device and determining a state of the porous body from detection results obtained in the image quality detecting device.

Further, the ink is applied to the ink receiving medium by an ink jet method.

According to the present invention, the state of the porous body can be determined based on image quality detection results of image quality obtained in the image quality detecting device from the test pattern, for checking image quality, formed similarly to the image. Based on this determination, more suitable processing on the porous body can be performed, such that an ink jet printing method and an ink jet printing apparatus having high reliability can be provided. When the porous body is repeatedly used to absorb and remove a liquid component from the image, a liquid absorption function may be deteriorated and thus, a smeared image may occur. According to the present invention, processing on the porous body can also be performed at a suitable timing before the occurrence of the smeared image by determining the state of the porous body to predict occurrence timing of the smeared image.

In the ink jet printing apparatus according to the present invention, an ink image forming unit (image forming unit) is not particularly limited as long as it can form the image (ink image) containing the aqueous liquid component and the coloring material on the ink receiving medium. In addition, an image formed by the image forming unit before being subjected to liquid absorption treatment by the liquid absorbing member is referred to as "an ink image before liquid removal". Further, an image in which a content of the aqueous liquid component is decreased by performing liquid absorption treatment is also referred to as "an ink image after liquid removal".

The image as a target subjected to liquid absorption treatment is formed by applying the reaction liquid and the ink onto the ink receiving medium so as to have at least overlapping regions. Fixability of the coloring material applied together with the ink onto the ink receiving medium is promoted and improved by the reaction liquid. Promotion and improvement of the fixability of the coloring material means that fluidity of the ink itself or the coloring material in the ink is decreased by an action of the reaction liquid and thus a state of the ink is changed from an initial state in which the ink applied onto the ink receiving medium has fluidity to a fixed state in which the ink is relatively thickened and has a difficulty in flowing as compared to the initial state. The mechanism is described below.

The image formed by the image forming unit is formed to contain a mixture reaction liquid and the ink. The aqueous liquid medium containing water is contained in the ink, and if necessary, an aqueous liquid medium containing water is contained in the reaction liquid. Therefore, an aqueous liquid component containing water supplied from these aqueous liquid media is contained in the image together with the coloring material.

As an ink applying device applying the ink onto the ink receiving medium, an ink jet printing device is used.

Further, the reaction liquid can contain a component improving fixability of the coloring material by chemically or physically reacting with the ink to make the mixture of the reaction liquid and the ink more viscous than each of the reaction liquid and the ink. The reaction liquid can contain the aqueous liquid medium. The aqueous liquid medium contains at least water, and if necessary, the aqueous liquid medium contains a water-soluble organic solvent or various additives.

At least one of the reaction liquid and the ink can contain a second liquid other than a first liquid when water is used as the first liquid. It does not matter whether volatility of the second liquid is high or low, but it is preferable that the second liquid is a liquid having higher volatility than that of the first liquid.

Hereinafter, an exemplary embodiment of the present invention is described.

<Reaction Liquid Applying Device>

As the reaction liquid applying device, any device capable of applying the reaction liquid onto the ink receiving medium may be used, and various devices known in the art can be suitably used. Specific examples thereof can include a gravure offset roller, an ink jet head, a die coating device (die coater), a blade coating device (blade coater), etc. Application of the reaction liquid by the reaction liquid applying device may be performed before or after the ink is applied as long as the reaction liquid can be mixed (react) with the ink on the ink receiving medium. Preferably, the reaction liquid is applied before application of the ink. The reaction liquid is applied before the ink is applied, such that bleeding in which adjacently applied inks are mixed at the time of printing an image by the ink jet method, or beading in which previously landed ink is attracted to the ink landed later can be also suppressed.

<Reaction Liquid>

The reaction liquid contains a component (ink viscosity increasing component) increasing a viscosity of the ink. To increase the viscosity of the ink includes a case in which the coloring material, a resin, etc., which is a portion of the composition constituting the ink, comes in contact with the ink viscosity increasing component to thereby chemically react therewith or be physically adsorbed therein, and thus an increase in the viscosity of the entire ink is recognized, or a case in which the components constituting the ink such as the coloring material are partially aggregated and thus the viscosity is locally increased. The ink viscosity increasing component has an effect of suppressing bleeding or beading at the time of forming the image using the ink by partially decreasing fluidity of the ink and/or an ink composition on the ink receiving medium. As the ink viscosity increasing component as described above, materials known in the art such as a polyvalent metal ion, an organic acid, a cation polymer and porous fine particles can be used. Among them, particularly, the polyvalent metal ion and the organic acid are preferable. Further, it is preferable that plural kinds of ink viscosity increasing components are contained in the reaction liquid. In addition, it is preferable that a content of the ink viscosity increasing component in the reaction liquid is 5 mass % or more based on a total mass of the reaction liquid.

Examples of the polyvalent metal ion can include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$.

Further, examples of the organic acid can include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, dioxysuccinic acid and the like.

The reaction liquid can contain a suitable amount of water or a low-volatile organic solvent. It is preferable that water used in this case is deionized water by ion exchange or the like. Further, the organic solvent usable in the reaction liquid applied to the present invention is not particularly limited, but an organic solvent known in the art can be used.

In addition, the reaction liquid of which surface tension and a viscosity is suitably adjusted by adding a surfactant or a viscosity adjusting agent can be used. A material to be used is not particularly limited as long as it can coexist with the ink viscosity increasing component. Specific examples of the surfactant to be used can include an acetylene glycol ethylene oxide adduct (trade name: "Acetylenol E100", manufactured by Kawaken Fine Chemicals Co., Ltd.), a perfluoroalkyl ethylene oxide adduct (trade name: "Megaface F444", product name manufactured by DIC Corporation) and the like.

<Ink Applying Device>

According to the present exemplary embodiment, as the ink applying device applying the ink, an ink jet head is used. Examples of the ink jet head can include an ink jet head ejecting ink by generating film boiling in the ink using an electro-thermal transducer to form bubbles, an ink jet head ejecting ink by electro-mechanical transducer, an ink jet head ejecting ink using static electricity and the like. In the present exemplary embodiment, ink jet heads known in the art can be used. Among them, particularly, an ink jet head using the electro-thermal transducer is preferably used in view of high-speed and high-density printing. Drawing is performed by receiving an image signal and applied with the required amount of ink to each position.

An ink application amount can be expressed by an image density (duty) or an ink thickness, but in the present exemplary embodiment, an average value obtained by multiplying a mass of each ink dot by the number of ink dots and dividing it by a printed area is defined as the ink application amount ($g/m^2$). In addition, a maximum ink application amount in an image region means an ink application amount applied in an area of at least 5 $mm^2$ in a region used as information of the ink receiving medium in view of removing the liquid component in the ink.

The ink applying device may have a plurality of ink jet heads in order to apply color ink having each color onto the ink receiving medium. For example, in the case of forming respective color images using yellow ink, magenta ink, cyan ink, and black ink, the ink applying device has four ink jet heads ejecting four kinds of inks onto the ink receiving medium, respectively, and these ink jet heads are disposed to line up in an X direction.

In addition, the ink applying device may include an ink jet head ejecting clear ink that does not contain a coloring material or is substantially transparent due to a significantly small ratio of the coloring material even if the clear ink contains the coloring material. Further, the clear ink can be used together with the reaction liquid and the color ink in order to form the ink image. For example, in order to improve glossiness of the image, this clear ink can be used. It is preferable to suitably adjust a resin component to be blended and further control an ejection position of the clear ink so that the image gives a glossy feeling.

Since it is preferable that the clear ink is located on a surface layer side as compared to the color ink in a final printed matter, in a transfer type printing apparatus, there is a need to apply the clear ink onto the transfer body before the color ink. To this end, in a movement direction of a transfer body 101 facing the ink applying device, the ink jet head for clear ink can be disposed on an upstream side as compared to the ink jet head for color ink.

Further, the clear ink can be used to improve transferability of the image from the transfer body to the printing medium, separately from improving glossiness. For example, the clear ink can be used as a transferability improving liquid to be applied onto the transfer body by containing a component exhibiting adhesiveness more than color ink to impart adhesiveness to the color ink. For example, an ink jet head for clear ink for improving transferability is disposed on the upstream side as compared to the ink jet head for color ink in the movement direction of the transfer body 101 facing the ink applying device. In addition, after the color ink is applied onto the transfer body, the clear ink is applied onto the transfer body after the color ink is applied, such that the clear ink exists on an outermost surface of the ink image. In the transfer of the ink image to the printing medium in a transfer part, the clear ink on the surface of the ink image adheres to the printing medium with a certain degree of adhesive force, whereby the ink image after liquid removal easily moves to the printing medium.

Each component of the ink applied to the present exemplary embodiment is described.

<Ink>

(Coloring Material)

As the coloring material contained in the ink applied to the present exemplary embodiment, a pigment or a mixture of a dye and a pigment can be used. The kind of pigment capable of being used as the coloring material is not particularly limited. Specific examples of the pigment can include inorganic pigments such as carbon black and organic pigments such as azo based pigments, phthalocyanine based pigments, quinacridone based pigments, isoindolinone based pigments, imidazolone based pigments, diketopyrrolopyrrole based pigments and dioxazine based pigments. If necessary, one or two kinds or more of these pigments can be used.

The kind of dye capable of being used as the coloring material is not particularly limited. Specific examples of the dye can include direct dyes, acidic dyes, basic dyes, disperse dyes, edible dyes and the like, and dyes having anionic groups can be used. Specific examples of a dye skeleton can include an azo skeleton, a triphenylmethane skeleton, a phthalocyanine skeleton, an azaphthalocyanine skeleton, a xanthene skeleton, an anthrapyridone skeleton and the like.

A content of the pigment in the ink is preferably 0.5 mass % or more to 15.0 mass % or less, more preferably 1.0 mass % or more to 10.0 mass % or less based on a total mass of the ink.

(Dispersant)

As a dispersant dispersing the pigment, known dispersants used in ink for ink jet can be used. Among them, in the present exemplary embodiment, it is preferable to use a water-soluble dispersant simultaneously having a hydrophilic portion and a hydrophobic portion in a structure. Particularly, a pigment dispersant composed of a resin obtained by copolymerizing at least a hydrophilic monomer and a hydrophobic monomer is preferably used. Here, there is no particular limitation in the used monomers, and monomers known in the art are preferably used. Specific examples of the hydrophobic monomer can include styrene and other styrene derivatives, alkyl(meth)acrylate, benzyl(meth)acrylate and the like. Further, examples of the hydrophilic monomer can include acrylic acid, methacrylic acid, maleic acid and the like.

It is preferable that an acid value of the dispersant is 50 mgKOH/g or more to 550 mgKOH/g or less. Further, it is preferable that a weight average molecular weight of the dispersant is 1000 or more to 50000 or less. In addition, it is preferable that a mass ratio of the pigment and the dispersant is in a range of 1:0.1 to 1:3 (pigment:dispersant).

Further, in the present exemplary embodiment, it is also preferable to use a so-called self-dispersible pigment in which the pigment itself is surface-modified so that it can be dispersed without using a dispersant.

(Resin Fine Particle)

The ink applied to the present exemplary embodiment can contain various fine particles that do not have a coloring material. Among them, resin fine particles are preferable in that the resin fine particles have an effect of improving image quality or fixability.

A material of the resin fine particles capable of being used in the present exemplary embodiment is not particularly limited, and a resin known in the art can be appropriately used. Specific examples of the resin can include homopolymers such as polyolefin, polystyrene, polyurethane, polyester, polyether, polyurea, polyamide, polyvinyl alcohol, poly(meth)acrylic acid and salts thereof, alkyl poly(meth) acrylate and polydiene; or copolymers obtained by polymerizing a combination of a plurality of monomers for producing these homopolymers. It is preferable that a weight average molecular weight (Mw) of the resin is in a range of 1,000 or more to 2,000,000 or less. Further, an amount of the resin fine particles in the ink is preferably 1 mass % or more to 50 mass % or less and more preferably 2 mass % or more to 40 mass % or less based on the total mass of the ink.

Further, in the present exemplary embodiment, it is preferable to use a resin fine particle dispersion in which the resin fine particles are dispersed in a liquid. A dispersion method is not particularly limited, but a so-called self-dispersible resin fine particle dispersion in which resin fine particles are dispersed using a resin obtained by homopolymerizing a monomer having a dissociable group or copolymerizing a plurality of kinds of monomers is preferable. Here, examples of the dissociable group can include a carboxyl group, a sulfonic acid group, a phosphoric acid group and the like, and examples of the monomer having such a dissociable group can include acrylic acid, methacrylic acid or the like. In addition, similarly, a so-called emulsified dispersion type resin fine particle dispersion in which resin fine particles are dispersed using an emulsifier can also be preferably used in the present exemplary embodiment. Here, as the emulsifier, a surfactant known in the art is preferable regardless of a low molecular weight and a high molecular weight. It is preferable that the surfactant is a non-ionic surfactant or a surfactant having the same charge as that of the resin fine particles.

The resin fine particle dispersion used in the present exemplary embodiment has a dispersed particle diameter of preferably 10 nm or more to 1000 nm or less and more preferably 100 nm or more to 500 nm or less.

It is also preferable to add various additives for stabilization at the time of preparing the resin fine particle dispersion used in the present exemplary embodiment. Examples of the additive can include n-hexadecane, dodecyl methacrylate, stearyl methacrylate, chlorobenzene, dodecyl mercaptan, a blue dye (bluing agent), polymethyl methacrylate and the like.

(Surfactant)

The ink capable of being used in the present exemplary embodiment may contain a surfactant. Specific examples of the surfactant can include an acetylene glycol ethylene oxide adduct (Acetylenol E100, manufactured by Kawaken Fine Chemicals Co., Ltd.) and the like. A content of the surfactant in the ink is preferably 0.01 mass % or more to 5.0 mass % or less based on the total mass of the ink.

(Water and Water-soluble Organic Solvent)

The ink used in the present exemplary embodiment can contain water and/or a water-soluble organic solvent as a solvent. It is preferable that water is deionized water by ion exchange or the like. Further, it is preferable that a content of water in the ink is 30 mass % or more to 97 mass % or less based on the total mass of the ink.

In addition, the kind of used water-soluble organic solvent is not particularly limited, but all the water-soluble organic solvents known in the art can be used. Specific examples of the water-soluble organic solvent can include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, methanol and the like. Of course, a mixture of two or more selected from these water-soluble organic solvents can be used.

Further, it is preferable that a content of the water-soluble organic solvent in the ink is 3 mass % or more to 70 mass % or less based on the total mass of the ink.

(Other Additives)

If necessary, the ink capable of being used in the present exemplary embodiment may contain various additives such as a pH adjusting agent, a rust preventive, an antiseptic, an antifungal agent, an antioxidant, a reduction inhibitor, a water-soluble resin and a neutralizing agent thereof and a viscosity modifier in addition to the above-mentioned components.

<Liquid Absorbing Member>

In the present exemplary embodiment, a content of the liquid component in the ink image is decreased by contacting the liquid component with the liquid absorbing member having the porous body with the ink image before liquid removal to at least partially remove the liquid component therefrom. A contact surface of the liquid absorbing member with the ink image is defined as a first surface, and the porous body is disposed on the first surface. It is preferable that the liquid absorbing member having the porous body as described above has a shape in which the liquid absorbing member can move in sync with movement of the ink receiving medium and perform liquid absorption by circulating at a predetermined cycle to contact with another ink image before performing liquid removal again after coming into contact with the ink image. For example, the liquid absorbing member can have an endless belt shape, a drum shape or the like.

(Porous Body)

As the porous body of the liquid absorbing member according to the present exemplary embodiment, it is preferable to use a porous body having an average pore diameter on a first surface side smaller than an average pore diameter on a second surface side opposed to the first surface. In order to suppress the coloring material in the ink from being attached to the porous body, it is preferable that the pore diameter is small. It is preferable that the average pore diameter of the porous body on at least the first surface side, contacting with the image is 10 μm or less. Further, as used herein, the average pore diameter means an average diameter at the first or second surface, and can be measured by a method known in the art, for example, a mercury press-in method, a nitrogen adsorption method, an SEM image observation method or the like.

Further, it is preferable to decrease a thickness of the porous body in order to have uniformly high air permeability. Air permeability can be expressed by a Gurley value defined in JIS P8117, and it is preferable that the Gurley value is 10 seconds or less.

However, in the case of decreasing the thickness of the porous body, since the porous body may fail to secure a capacity enough to absorb the liquid component, the porous body can have a multilayer configuration. Further, in the liquid absorbing member, it is preferable that a layer contacting with the ink image is the porous body, and a layer that does not contact with the ink image may not be the porous body.

Next, an exemplary embodiment in which the porous body has a multilayer configuration is described. Here, a first layer on a side in contact with the ink image and a layer laminated on a surface of the first layer opposite to a contact surface of the first layer with the ink image as a second layer are described. Further, in the multilayer configuration, respective layers are sequentially expressed in the order of lamination from the first layer. Further, in the present specification, the first layer may be referred to as an "absorption layer" and the second layer and subsequent layers may be referred to as "support layer".

[First Layer]

In the present exemplary embodiment, a material of the first layer is not particularly limited, but both a hydrophilic material having a contact angle of less than 90° with respect to water and a water-repellent material having a contact angle of 90° or more with respect to water can be used.

The hydrophilic material is preferably selected from a single material such as cellulose and polyacrylamide, a composite material thereof or the like. Further, the following water-repellent material can also be subjected to hydrophilic surface treatment and then used. Examples of hydrophilic treatment can include a sputter etching, radioactive ray or $H_2O$ ion irradiation, excimer (ultraviolet) laser light irradiation and the like.

In the case of the hydrophilic material, the contact angle with respect water is more preferably 60° or less. The hydrophilic material has an effect of sucking up a liquid, particularly water by capillary force.

Meanwhile, in order to suppress attachment of the coloring material and improve a cleaning property, it is preferable that the material of the first layer is a water-repellent material having low surface free energy, particularly, a fluororesin. Specific examples of the fluororesin can include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene.hexafluoropropylene copolymer (FEP), an ethylene.tetrafluoroethylene copolymer (ETFE), an ethylene.chlorotrifluoroethylene copolymer (ECTFE) and the like. If necessary, one kind or two or more kinds of these resins can be used, and a configuration in which a plurality of films are laminated in the first layer may be adopted. In the case of the water-repellent material, there is almost no effect of sucking up the liquid by capillary force, and it takes time to suck up the liquid at the time of initially contacting with the image. For this reason, it is preferable to allow a liquid having a contact angle of less than 90° with respect to the first layer to be impregnated into the first layer. This liquid can be impregnated into the first layer by applying the liquid into the first surface of the liquid absorbing member. This liquid is preferably prepared by mixing a surfactant or a liquid having a low contact angle with the first layer and water with each other.

In the present exemplary embodiment, it is preferable that the first layer has a film thickness of 50 μm or less. It is more preferable that the film thickness is 30 μm or less. In the present exemplary embodiment, the film thickness was obtained by measuring film thicknesses at 10 random points using a linear micrometer OMV-25 (manufactured by Mitutoyo Corporation) and calculating an average value thereof.

The first layer can be manufactured by a known method for manufacturing a thin porous film. For example, after obtaining a sheet-shaped material using a resin material by a method such as an extrusion molding method, the sheet-shaped material can be drawn at a predetermined thickness, thereby obtaining the first layer. Alternatively, a plasticizer such as paraffin can be added to a material for extrusion molding, and the plasticizer can be removed, for example, by heating at the time of drawing, thereby obtaining the first layer as a porous film. The pore diameter can be adjusted by appropriately adjusting an amount of the added plasticizer, a draw ratio and the like.

[Second Layer]

In the present exemplary embodiment, the second layer is preferably a layer having air permeability. This layer may be either a non-woven fabric or a woven fabric of resin fibers. A material of the second layer is not particularly limited, but in order to prevent the liquid absorbed in the first layer from flowing back, it is preferable that the material of the second layer is a material of which a contact angle with respect to the first liquid is equal to or lower than that of the first layer. Specifically, the material is preferably selected from single materials such as polyolefins (such as polyethylene (PE) and polypropylene (PP)), polyurethanes, polyamides such as nylons, polyesters (such as polyethylene terephthalate (PET)), and polysulfone (PSF) or composite materials of them. Further, it is preferable that the second layer is a layer having a pore diameter larger than that of the first layer.

[Third Layer]

In the present exemplary embodiment, the porous body having a multilayer structure may include three or more layers, but is not limited thereto. The third and subsequent layers are preferably made of non-woven fabric in view of rigidity. As a material, a material similar to that of the second layer is used.

[Other Materials]

The liquid absorbing member may include, in addition to the porous body having a multilayer structure, a reinforcing member that reinforces side surfaces of the liquid absorbing member. Further, the liquid absorbing member may also include an adhesive member in the case of connecting longitudinal end portions of a long sheet-shaped porous body to each other to form a belt-shape member. As an example of this material, a non-porous tape material, etc. can be used, and may be disposed at a position or a cycle at which it does not contact with images.

[Manufacturing Method of Porous Body]

A method of laminating the first and second layers to form the porous body is not particularly limited. The first and second layers may be simply overlapped or bonded to each other by a technique such as lamination by an adhesive agent or lamination by heating. In view of air permeability, lamination by heating is preferable in the present exemplary embodiment. Alternatively, for example, the first layer or the second layer may be partly melted by heating, and the layers may be adhesively laminated. In addition, a fusing material such as a hot melt powder may be interposed between the first and second layers, and the layers may be adhesively laminated by heating. When a third or subsequent layer is laminated, layers may be laminated at once, or may be sequentially laminated, and a lamination order is appropriately selected.

In a heating step, a lamination method in which the porous body is heated while the porous body is interposed between heated rollers and pressed is preferable.

Next, a specific exemplary embodiment of the ink jet printing apparatus according to the present invention is described.

As the ink jet printing apparatus according to the present invention, the following apparatuses can be adopted.

(A) An ink jet printing apparatus in which an image (ink image before liquid removal) is formed on a transfer body as an ink receiving medium and an image after a liquid component is absorbed by a liquid absorbing member (ink image after liquid removal) is transferred onto a printing medium.

(B) An ink jet printing apparatus in which an image is formed on a printing medium as an ink receiving medium.

Further, in the present invention, for convenience, the former (the ink jet printing apparatus described in (A)) is referred to as a transfer type ink jet printing apparatus, and the latter (the ink jet printing apparatus described in (B)) is referred to as a direct drawing type ink jet printing apparatus.

In the transfer type ink jet printing apparatus, the transfer body temporarily holds an image on its image forming surface, an image temporarily held on the transfer body is transferred onto a printing medium, such that a final image is formed on the printing medium.

Hereinafter, each of the ink jet printing apparatuses is described.

(Transfer Type Ink Jet Printing Apparatus)

FIG. 1 is a schematic diagram illustrating an example of a schematic configuration of a transfer type ink jet printing apparatus 100 according to the present exemplary embodiment.

This printing apparatus is a single-wafer type ink jet printing apparatus which manufactures a printed matter by transferring an ink image onto a printing medium 108 via a transfer body 101. In the present exemplary embodiment, an X direction, a Y direction and a Z direction refer to a width direction (full length direction), a depth direction, and a height direction of the ink jet printing apparatus 100, respectively. The printing medium P is conveyed in the X direction.

As illustrated in FIG. 1, the transfer type ink jet printing apparatus 100 according to the present invention includes the transfer body 101 supported by a support member 102, a reaction liquid applying device 103 applying a reaction liquid reacting with color ink onto the transfer body 101, an ink applying device 104 including an ink jet head applying the color ink onto the transfer body 101 applied with the reaction liquid to form an ink image corresponding to an image by the ink on the transfer body, a liquid absorbing device 105 absorbing a liquid component from the ink image on the transfer body, and a transfer pressing member 106 for transferring the ink image from which the liquid component has been removed on the transfer body onto the printing medium 108 such as paper. In the present invention, a transfer unit is formed by the transfer pressing member 106, the support member 102 of the transfer body 101, and a printing medium conveyance device 107.

Further, if necessary, the transfer type ink jet printing apparatus 100 may include a cleaning member 109 for a transfer body, which cleans a surface of the transfer body 101 after the transfer. Further, the liquid absorbing device 105 includes a cleaning device 110 for a liquid absorbing member, which cleans a surface of a liquid absorbing member 105*a*, a pre-treatment liquid storage part 111*a* and a pre-treatment liquid applying member 111*b* and may include a pre-treatment member 111 applying a pre-treatment liquid onto the liquid absorbing member 105*a*. Further, the liquid absorbing device 105 includes a holding liquid amount adjusting member 112*b* and a holding liquid storage part 112*a* and may include a holding liquid amount adjusting device 112 adjusting a holding liquid amount of the liquid absorbing member 105*a* to a suitable amount.

Of course, the transfer body 101, the reaction liquid applying device 103, an ink jet head of the ink applying device 104, the liquid absorbing device 105 and the cleaning member 109 for a transfer body, the cleaning device 110 for a liquid absorbing member, the pre-treatment member 111 and the holding liquid amount adjusting member 112 have lengths corresponding to the used printing medium 108 in the Y direction, respectively. The transfer body 101 rotates based on a rotation shaft 102*a* of the support member 102 in an arrow A direction of FIG. 1. The transfer body 101 rotates due to rotation of the support member 102. On the moving transfer body 101, the reaction liquid and the ink are sequentially applied by the reaction liquid applying device 103 and the ink applying device 104, respectively, such that the ink image is formed on the transfer body 101. The ink image formed on the transfer body 101 is moved to a position at which the ink image comes in contact with the liquid absorbing member 105*a* of the liquid absorbing device 105 by movement of the transfer body 101.

The transfer body 101 and the liquid absorbing device 105 move in sync with the rotation of the transfer body 101, and the liquid absorbing device rotates in an arrow B direction of FIG. 1. The ink image formed on the transfer body 101 comes in contact with this moving liquid absorbing member 105*a*. Meanwhile, the liquid absorbing member 105*a* removes the liquid component from the ink image on the transfer body. It is particularly preferable that the liquid absorbing member 105*a* is pressed on the transfer body 101 with a predetermined pressing force in this contact state in view of allowing the liquid absorbing member 105*a* to effectively function.

The removal of the liquid component can be expressed from a different point of view as concentrating the ink constituting the image formed on the transfer body. Concentrating the ink means that a proportion of the solid content contained in the ink, such as the coloring material and the resin, with respect to the liquid component contained in the ink increases owing to reduction in the liquid component.

In addition, the ink image after liquid removal from which the liquid component is removed is in a state in which the ink is concentrated as compared to the ink image before liquid removal to thereby be moved to the transfer part coming in contact with the printing medium 108 conveyed by the printing medium conveyance device 107 by the transfer body 101 again. While the ink image after liquid removal comes in contact with the printing medium 108, the pressing member 106 presses the transfer body 101, such that the ink image is transferred onto the printing medium 108. The ink image after the transfer, transferred onto the printing medium 108 is a reverse image of the ink image before liquid removal and the ink image after liquid removal.

Further, in the present exemplary embodiment, since the image is formed by applying the ink after applying the reaction liquid onto the transfer body, the reaction liquid has not reacted with the ink but remains in a non-image region in which the image by the ink is not formed. In the present apparatus, the liquid absorbing member 105*a* comes in contact with not only the image but also an unreacted reaction liquid, such that a liquid component of the reaction liquid is also removed.

Therefore, although the above description expresses that the liquid component is removed from the image, the expression is not limited to removal of the liquid component only from the image, but means that the liquid component is removed at least from the image on the transfer body.

In addition, the liquid component is not particularly limited as long as the liquid component does not have a constant shape and has fluidity and an almost constant volume.

Examples of the liquid component can include water, an organic solvent, etc. contained in the ink or the reaction liquid.

Each configuration of the transfer type ink jet printing apparatus according to the present exemplary embodiment is described below.

<Transfer Body>

The transfer body 101 has a surface layer including an image forming surface. As a member of the surface layer, various materials, such as resins and ceramics, can be suitably used, but, in view of durability, etc., a material having a high compressive elastic modulus is preferable. Specific examples thereof can include an acrylic resin, an acrylic silicone resin, a fluorine-containing resin, a condensate prepared by condensation of a hydrolyzable organic silicon compound, and the like. In order to improve wettability of a reaction liquid, transferability, etc., a surface treatment may be performed. Examples of the surface treatment can include flame treatment, corona treatment, plasma treatment, polishing treatment, roughening treatment, active energy ray-irradiation treatment, ozone treatment, surfactant treatment, silane coupling treatment, and the like. A combination of two kinds or more of these treatments may be performed. Further, an arbitrary surface shape can also be provided on the surface layer.

In addition, it is preferable that the transfer body has a compression layer having a function of absorbing pressure fluctuations. The compression layer is provided, such that the compression layer can absorb deformation to disperse local pressure fluctuations, thereby making it possible to maintain satisfactory transferability even during high-speed printing. As a member of the compression layer, for example, acrylonitrile-butadiene rubber, acrylic rubber, chloroprene rubber, urethane rubber, silicone rubber and the like can be used. At the time of molding such a rubber material, it is preferable to add predetermined amounts of a vulcanizing agent, a vulcanization accelerator and the like are added, and further add a foaming agent, hollow fine particles or a filler such as sodium chloride as needed to form a porous material. Therefore, since bubble portions are compressed with volume changes against various pressure fluctuations, deformation except in a compression direction is small, and more stable transferability and durability can be achieved. As a porous rubber material, there are a material having a continuous pore structure in which pores are connected to each other and a material having a closed pore structure in which pores are independent of each other. In the present invention, either of the structures may be used, or the structures may be used in combination.

Further, the transfer body preferably further includes an elastic layer between the surface layer and the compression layer. As a member of the elastic layer, various materials such as resins and ceramics can be suitably used. In view of processing properties, various elastomer materials and rubber materials are preferably used. Specific examples thereof can include fluorosilicone rubber, phenylsilicone rubber, fluororubber, chloroprene rubber, urethane rubber, nitrile rubber, ethylenepropylene rubber, natural rubber, styrene rubber, isoprene rubber, butadiene rubber, ethylene/propylene/butadiene copolymers, nitrile-butadiene rubber and the like. Particularly, in view of dimensional stability and durability, since silicone rubber, fluorosilicone rubber and phenylsilicone rubber have a small have a small compression permanent set, these materials are preferable. Further, these materials are preferable in view of a small change in elastic modulus caused by a temperature and transferability.

Various adhesives or double-sided tapes may be interposed between the respective layers (the surface layer, the elastic layer and the compression layer) constituting the transfer body in order to fix/hold these layers. In addition, the transfer body may also include a reinforcing layer having a high compressive elastic modulus in order to suppress lateral elongation when installed in an apparatus or to maintain elasticity. Further, a woven fabric may be used as the reinforcing layer. The transfer body can be manufactured by optionally combining the respective layers made of the above-mentioned materials.

A size of the transfer body can be freely selected depending on a size of a target print image. A shape of the transfer body is not particularly limited. Specific examples of the shape of the transfer body can include a sheet shape, a roller shape, a belt shape, an endless web shape and the like.

<Support Member>

The transfer body 101 is supported on the support member 102. As a method of supporting the transfer body, various adhesives or double-sided tapes may be used. Alternatively, by attaching an installing member made of a metal, ceramics, a resin or the like to the transfer body, the transfer body may be supported on the support member 102 by using the installing member.

The support member 102 needs to have a certain degree of structural strength in view of conveyance accuracy or durability. As a material of the support member, metals, ceramics, resins and the like are preferably used. Among them, aluminum, iron, stainless steel, acetal resins, epoxy resins, polyimide, polyethylene, polyethylene terephthalate, nylon, polyurethane, silica ceramics and alumina ceramics are preferably used in order to decrease inertia during operation and improve control responsivity in addition to rigidity capable of withstanding the pressure at the time of transfer, dimensional accuracy. In addition, a combination thereof is preferably used.

<Reaction Liquid Applying Device>

The ink jet printing apparatus according to the present exemplary embodiment includes the reaction liquid applying device 103 applying the reaction liquid onto the transfer body 101. A case in which the reaction liquid applying device 103 is a gravure offset roller having a reaction liquid storage part 103*a* receiving the reaction liquid and reaction liquid applying members 103*b* and 103*c* applying the reaction liquid in the reaction liquid storage part 103*a* onto the transfer body 101 is illustrated in FIG. 1.

<Ink Applying Device>

The ink jet printing apparatus according to the present exemplary embodiment includes the ink applying device 104 applying the ink onto the transfer body 101. The reaction liquid and the ink are mixed with each other on the transfer body, such that the ink image is formed by the reaction liquid and the ink and the liquid component is absorbed from the ink image in the liquid absorbing device 105.

In the present exemplary embodiment, an ink jet head is a full-line head extended and installed in the Y direction, and nozzles are arranged in a range covering a width of an image printing region of a printing medium with a maximum usable size. The ink jet head has an ink ejection surface whose nozzles are opened on a lower surface thereof (toward the transfer body 101), and the ink ejection surface faces the surface of the transfer body 101 with a minute gap (about several millimeters) therebetween.

The ink applying device 104 may include a plurality of ink jet heads in order to apply respective color inks onto the ink receiving medium. For example, in the case of forming respective color images using yellow ink, magenta ink, cyan ink, and black ink, the ink applying device has four ink jet heads ejecting four kinds of inks onto the ink receiving medium, respectively, and these ink jet heads are disposed to line up in the X direction.

In addition, the ink applying device may include an ink jet head ejecting clear ink that does not contain a coloring material or is substantially transparent due to a significantly small ratio of the coloring material even if the clear ink contains the coloring material. Further, the clear ink can be used together with the reaction liquid and the color ink in order to form the ink image. For example, in order to improve glossiness of the image, this clear ink can be used. It is preferable to suitably adjust a resin component to be blended and further control an ejection position of the clear ink so that the image after the transfer gives a glossy feeling. Since it is preferable that the clear ink is located on a surface layer side as compared to the color ink in a final printed matter, in the transfer type printing apparatus, there is a need to apply the clear ink onto the transfer body 101 before the color ink. To this end, in a movement direction of the transfer body 101 facing the ink applying device 104, the ink jet head for clear ink can be disposed on an upstream side as compared to the ink jet head for color ink.

Further, the clear ink can be used to improve transferability of the image from the transfer body 101 to the printing medium, separately from improving glossiness. For example, the clear ink can be used as a transferability improving liquid to be applied onto the transfer body 101 by containing a component exhibiting adhesiveness more than color ink to impart adhesiveness to the color ink. For example, an ink jet head for clear ink for improving transferability is disposed on the upstream side as compared to the ink jet head for color ink in the movement direction of the transfer body 101 facing the ink applying device 104. In addition, after the color ink is applied onto the transfer body 101, the clear ink is applied onto the transfer body after the color ink is applied, such that the clear ink exists on an outermost surface of the ink image. In the transfer of the ink image to the printing medium in the transfer part, the clear ink on the surface of the ink image adheres to the printing medium 108 with a certain degree of adhesive force, whereby the ink image after liquid removal easily moves to the printing medium 108.

<Liquid Absorbing Device>

In the present exemplary embodiment, the liquid absorbing device 105 includes the liquid absorbing member 105*a* and a pressing member 105*b* for the liquid absorbing member, which presses the liquid absorbing member 105*a* against the ink image on the transfer body 101. The liquid absorbing member 105*a* is conveyed by a liquid absorbing member conveyance device (not illustrated) and moved again to a liquid absorption treatment region in which the liquid absorbing member 105*a* comes in contact with the transfer body 101 to absorb the liquid from the image, such that the liquid absorbing member 105*a* can be repeatedly used.

A position of the pressing member 105*b* relative to the transfer body 101 can be adjusted by a position control mechanism (not illustrated). For example, the pressing member 105*b* can reciprocate in an arrow D direction illustrated in FIG. 1 and allow the liquid absorbing member 105*a* to come into contact with an outer peripheral surface of the transfer body 101 at the timing at which the liquid absorption treatment is required. Further, the liquid absorbing member 105*a* can be separated from the outer peripheral surface.

In addition, shapes of the liquid absorbing member 105*a* and the pressing member 105*b* are not particularly limited. For example, as illustrated in FIG. 1, the liquid absorbing member 105*a* and the pressing member 105*b* may have a configuration in which the pressing member 105*b* has a column shape, the liquid absorbing member 105*a* has a belt shape, and the column-shaped pressing member 105*b* presses the belt-shaped liquid absorbing member 105*a* against the transfer body 101. Alternatively, the liquid absorbing member 105*a* and the pressing member 105*b* may also have a configuration in which the pressing member 105*b* has a column shape, the liquid absorbing member 105*a* has a cylindrical shape formed on a peripheral surface of the pressing member 105*b* having the column shape, and the column-shaped pressing member 105*b* presses the cylindrical liquid absorbing member 105*a* against the transfer body.

In the present exemplary embodiment, the liquid absorbing member 105*a* preferably has a belt shape in consideration of a space in the ink jet printing apparatus, etc.

Further, the liquid absorbing device 105 including the belt-shaped liquid absorbing member 105*a* described above may also include an extending member extending the liquid absorbing member 105*a*. In the FIG. 1, an extending roller 105*c* serves as the extending member. In the present exemplary embodiment, at least one of the extending rollers 105*c* is used as a driving roller for conveying the liquid absorbing member 105*a*, thereby constituting a liquid absorbing member conveyance device. Further, a shape of the liquid absorbing member conveyance device is not limited thereto, but configurations of various conveyance devices can be used.

In FIG. 1, the pressing member 105*b* is a rotating roller member similarly to the extending roller, but is not limited thereto. In the liquid absorbing device 105, the liquid absorbing member 105*a* including a porous body is pressed by the pressing member 105*b* to come in contact with the ink image, such that the liquid absorbing member 105*a* absorbs the liquid component contained in the ink image, thereby decreasing the liquid component. As a method of decreasing the liquid component in the ink image, the present method of contacting the liquid absorbing member may be combined with other various methods used in the art, for example, a heating method, a method of blowing air with low humidity and a decompression method, etc. Further, the liquid component may be further decreased by applying these methods to the ink image after liquid removal from which the liquid component has been decreased.

Hereinafter, various conditions and configurations in the liquid absorbing device 105 are described in detail.

(Cleaning Treatment)

In the present exemplary embodiment, the liquid absorbing device 105 has the cleaning device 110 for a liquid absorbing member, which removes attached substances on the surface of the liquid absorbing member 105*a*. A cleaning member 110*a* for a liquid absorbing member rotates in sync with an operation of the liquid absorbing member 105*a* while coming in contact with the liquid absorbing member 105*a*, and removes paper powder, ink and the like which are unexpectedly attached to the liquid absorbing member 105*a*. The cleaning member 110*a* for a liquid absorbing member preferably has elasticity so as to exhibit a certain nip width and adhesive force and is preferably an elastic roller such as rubber. The attached substance in the cleaning member 110*a* for a liquid absorbing member is scraped off by a cleaning blade 110*b*. A contact pressure of the cleaning member 110*a* for a liquid absorbing member is not particularly limited, but the contact pressure is 0.01 MPa or more, which is preferable in that the attached substance can be stably removed. Further, the contact pressure is 1.0 MPa or less, which is preferable in that a structural load on the apparatus can be suppressed.

Further, the cleaning device for a liquid absorbing member can be installed so that the cleaning device can move to a position where cleaning is performed on the liquid absorbing member 105*a* and can perform an operation of separating the cleaning device for a liquid absorbing member from the liquid absorbing member 105*a*, for example, reciprocating movement in an arrow E direction illustrated in FIG. 1 at a time to be required. For example, the above-mentioned reciprocating movement can be performed by a configuration in which the cleaning device for a liquid absorbing member is disposed on a lifting stage (not illustrated) that can be raised and lowered by a lifting air cylinder (not illustrated).

(Pre-Treatment)

In the present exemplary embodiment, it is preferable to perform pre-treatment by a pre-treatment unit applying a treatment liquid to the liquid absorbing member before the liquid absorbing member 105*a* having the porous body comes in contact with the ink image. The treatment liquid used in the present exemplary embodiment preferably contains water and a water-soluble organic solvent. It is preferable that water is deionized water by ion exchange or the like. Further, the kind of water-soluble organic solvent is not particularly limited, but water-soluble organic solvents known in the art such as ethanol and isopropyl alcohol can all be used.

An application method of the treatment liquid to the porous body used in the present invention may be any method such as a dipping method, an application method, a liquid dropping method and the like, but is preferably a roller pressure type application method for stable application of the treatment liquid, high-speed application in an apparatus or the like.

In FIG. 1, a treatment liquid applying device 10 by a combination of a chamber filled with the pre-treatment liquid and an offset roller as the treatment liquid applying members 103*a* and 103*b* is illustrated.

In the present invention, a timing at which the treatment liquid is applied is not particularly limited. When a drum-shape or endless web-shaped liquid absorbing member is continuously, circularly conveyed to perform the pre-treatment, for example, the treatment liquid may be applied every cycle or may be applied once after several cycles. The timing of application of the treatment liquid may be appropriately controlled.

In addition, the pre-treatment liquid applying device can be installed so that the treatment liquid applying device can move to a position where the treatment liquid is applied to the liquid absorbing member 105*a* and can perform an operation of separating from the liquid absorbing member 105*a*, for example, reciprocating movement in an arrow F direction illustrated in FIG. 1 at an intended timing. For example, the above-mentioned reciprocating movement can be performed by a configuration in which the pre-treatment liquid applying device is disposed on a lifting stage (not illustrated) capable of moving up and down by a lifting air cylinder (not illustrated).

In the exemplary embodiment illustrated in FIG. 1, before the liquid absorbing member 105*a* comes in contact with the first image, as pre-treatment, the treatment liquid can be applied to the porous body of the liquid absorbing member by the pre-treatment liquid applying device 111 applying the treatment liquid.

An application pressure of the treatment liquid is not particularly limited, but the application pressure is 0.1 MPa or more, which is preferable in that the treatment liquid can be stably applied or be applied at a high speed in an apparatus. Further, the pressure is 1.0 MPa or less, which is preferable in that a structural load on the apparatus can be suppressed.

(Holding Liquid Amount Adjustment)

Further, the liquid absorbing device 105 includes the holding liquid amount adjusting member 112 for maintaining a liquid amount held in the liquid absorbing member 105*a* at a suitable amount. The holding liquid amount adjusting member 112*b* rotates in sync with the operation of the liquid absorbing member 105*a* while coming in contact with the liquid absorbing member 105*a*, to squeeze the liquid from the liquid absorbing member 105*a*. The squeezed liquid is received in the holding liquid storage part 112*a* and passes through a discharge path (not illustrated) to thereby be treated. The holding liquid amount adjusting member preferably has elasticity so as to secure a certain nip width and is preferably an elastic roller made of rubber, etc.

A contact pressure of the holding liquid amount adjusting member 112*b* is not particularly limited, but the contact pressure is 0.01 MPa or more, which is preferable in that the liquid unnecessarily held in the liquid absorbing member 105*a* can be stably removed. Further, the contact pressure is 1.0 MPa or less, which is preferable in that a structural load on the apparatus can be suppressed.

In addition, the holding liquid amount adjusting device can be installed so that the holding liquid amount adjusting device can move to a position where the holding liquid amount adjusting device adjusting a holding liquid amount with respect to the liquid absorbing member 105*a* and can perform an operation of separating from the liquid absorbing member 105*a*, for example, reciprocating movement in an arrow G direction illustrated in FIG. 1 at an intended timing. For example, the above-mentioned reciprocating movement can be performed by a configuration in which the holding liquid amount adjusting device is disposed on a lifting stage (not illustrated) capable of moving up and down by a lifting air cylinder (not illustrated).

(Pressing Conditions)

A pressure of the liquid absorbing member at the time of coming in contact with the ink image on the transfer body is 0.29 MPa (3 kgf/cm$^2$) or more, which is preferable in that the liquid component in the ink image can be separated by solid-liquid separation for a shorter time, and the liquid component can be removed from the ink image. Further, in the present specification, the pressure of the liquid absorbing member represents a nip pressure between the ink receiving medium and the liquid absorbing member, and is calculated by measuring a surface pressure using a surface pressure distribution measuring device (trade name: "I-SCAN", manufactured by Nitta Corporation), and dividing a load in a pressed region by an area.

(Application Time)

An application time for contact of the liquid absorbing member 105*a* with the ink image is preferably within 50 ms in order to further suppress the coloring material in the ink image from being attached to the liquid absorbing member. Further, in the present specification, the application time is calculated by dividing a pressure detection width in a movement direction of the ink receiving medium in the above-mentioned surface pressure measurement by a movement speed of the ink receiving medium. Hereinafter, the application time is referred to as a liquid absorbing nip time.

In this manner, an ink image in which the liquid component is absorbed therefrom to thereby be decreased is formed on the transfer body 101. Next, the ink image after liquid removal is transferred onto the printing medium 108 in the transfer part. Device configuration and conditions at the time of transfer will be described.

<Transfer Pressing Member>

In the present exemplary embodiment, the ink image after liquid removal on the transfer body 101 is allowed to come in contact with the printing medium 108 by the transfer pressing member 106 to thereby be transferred onto the printing medium 108 conveyed by a printing medium conveyance unit 107. A printing image in which curl, cockling or the like is suppressed can be obtained by transferring the ink image onto the printing medium 108 after removing the liquid component contained in the ink image on the transfer body 101.

The pressing member 106 needs to have a certain degree of structural strength in view of the conveyance accuracy of the printing medium 108 or durability. As the material of the pressing member 106, metals, ceramics, resins and the like are preferably used. Among them, aluminum, iron, stainless steel, acetal resins, epoxy resins, polyimide, polyethylene, polyethylene terephthalate, nylon, polyurethane, silica ceramics and alumina ceramics are preferably used in order to decrease inertia during operation and improve control responsivity in addition to rigidity capable of withstanding the pressure at the time of transfer, dimensional accuracy. Further, these materials may be used in combination.

A pressing time during which the pressing member 106 presses the transfer body 101 in order to transfer the ink image after liquid removal on the transfer body 101 to the printing medium 108 is not particularly limited, but is preferably 5 ms or more to 100 ms or less in order to satisfactorily transfer the ink image and not to degrade durability of the transfer body. Further, in the present exemplary embodiment, the pressing time indicates a time during which the printing medium 108 and the transfer body 101 come in contact with each other, and is calculated by measuring a surface pressure using a surface pressure distribution measuring device (trade name: "I-SCAN", manufactured by Nitta Corporation) and dividing a length of a pressed region in a conveyance direction by a conveyance speed.

Further, a pressure at which the pressing member 106 presses the transfer body 101 in order to transfer the ink image after liquid removal on the transfer body 101 to the printing medium 108 is not particularly limited, but is controlled so as to satisfactorily transfer the ink image and not to degrade durability of the transfer body. To this end, the pressure is preferably 0.1 MPa or more to 3.0 MPa or less. Further, in the present exemplary embodiment, the pressure indicates a nip pressure between the printing medium 108 and the transfer body 101 and is calculated by measuring a surface pressure using a surface pressure distribution measuring device and dividing a load in a pressed region by an area.

A temperature when the pressing member 106 presses the transfer body 101 in order to transfer the ink image after liquid removal on the transfer body 101 to the printing medium 108 is also not particularly limited, but is preferably equal to or more than a glass transition point or softening point of the resin component contained in the ink. Further, for heating, it is preferable to provide a heating unit heating the second image on the transfer body 101, the transfer body 101 and the printing medium 108.

A shape of a transfer unit 106 is not particularly limited, but the transfer unit 106 can have, for example, a roller shape.

<Printing Medium and Printing Medium Conveyance Device>

In the present exemplary embodiment, the printing medium 108 is not particularly limited, and any printing medium known in the art can be used. Examples of the printing medium can include long media rolled in a roll shape or sheet media cut at a predetermined size. Materials thereof can include paper, plastic films, wood boards, corrugated cardboards, metal films and the like.

Further, in FIG. 1, the printing medium conveyance device 107 for conveying the printing medium 108 is composed of a printing medium conveyance roller 107*a* and a printing medium winding roller 107*b*, but may be composed of any members capable of conveying the printing medium, and is not specifically limited to this structure.

<Control System>

Figure 3:
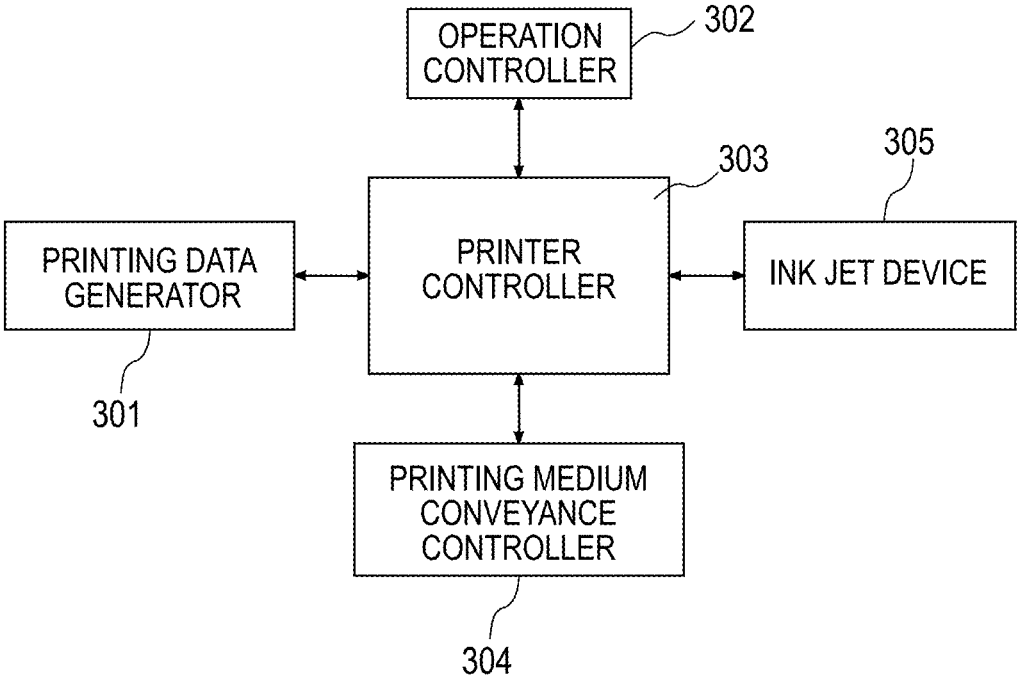
FIG. 3 is a block diagram illustrating a control system of the entire apparatus in the ink jet printing apparatuses illustrated in FIGS. 1 and 2.

The transfer type ink jet printing apparatus in the present exemplary embodiment has a control system for controlling each device as a device operation controller. FIG. 3 is a block diagram illustrating a control system for the entire apparatus in the transfer type ink jet printing apparatus illustrated in FIG. 1.

FIG. 3 illustrates a printing data generator 301 such as an external print server, an operation controller 302 such as an operation panel, a printer controller 303 for executing a printing step, a printing medium conveyance controller 304 for conveying the printing medium, and an ink jet device 305 for printing.

Figure 4:
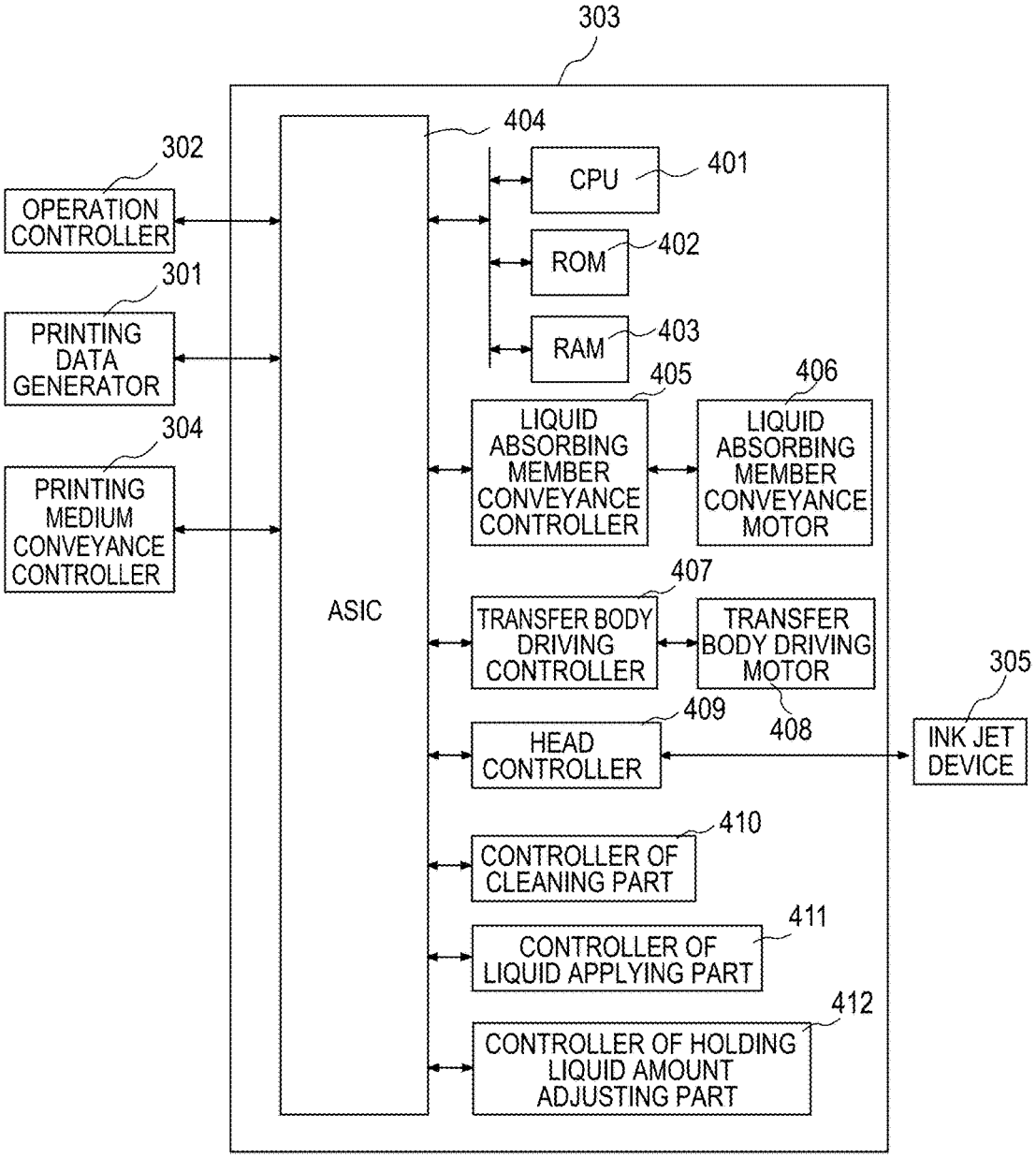
FIG. 4 is a block diagram of a printer controller in the transfer type ink jet printing apparatus illustrated in FIG. 1.

FIG. 4 is a block diagram of a printer controller in the transfer type ink jet printing apparatus of FIG. 1.

A CPU 401 controls the whole printer, a ROM 402 stores a control program of the CPU 401, and a RAM 403 executes a program. An application specific integrated circuit (ASIC) 404 is for a specific purpose, including a network controller, a serial IF controller, a controller for generating head data, a motor controller and the like. A liquid absorbing member conveyance controller 405 drives a liquid absorbing member conveyance motor 406, and the liquid absorbing member conveyance controller 405 is controlled by a command from the ASIC 404 via a serial IF. A transfer body driving controller 407 drives a transfer body driving motor 408, and the transfer body driving controller 407 is also controlled by a command from the ASIC 404 via a serial IF. A head controller 409 generates final ejection data of the ink jet device 305 and generates a driving voltage, etc. A controller 410 of a cleaning part can be used as a lifting controller of the cleaning device for a liquid absorbing member for driving a lifting air cylinder (not illustrated) of the cleaning device for a liquid absorbing member, that is, as a liquid absorbing member cleaning controller. The controller 410 of the cleaning part is controlled by a command from the ASIC 404 via a serial IF. A controller 411 of a liquid applying part can be used as a lifting controller of a recovery liquid applying device for driving a lifting air cylinder (not illustrated) of the recovery liquid applying device, that is, as a recovery liquid application controller. The controller 411 of the liquid applying part is controlled by a command from the ASIC 404 via a serial IF. A controller 412 of a holding liquid amount adjusting part can be used as a lifting controller of the holding liquid amount adjusting device for driving a lifting air cylinder (not illustrated) of the holding liquid amount adjusting device, that is, as a holding liquid amount adjustment controller. The controller 412 of the holding liquid amount adjusting part is controlled by a command from the ASIC 404 via a serial IF.

<Determination of State of Porous Body and Processing for Porous Body>

The ink jet printing apparatus according to the present exemplary embodiment has a system for determining a state of the porous body repeatedly conveyed to the liquid absorption treatment region by the liquid absorbing member conveyance device.

This system for determining the state of the porous body has an image quality detecting device detecting image quality of the image subjected to liquid absorption treatment in the liquid absorbing device and a porous body state determining unit determining the state of the porous body. The porous body state determining unit can be composed of the CPU 401, the ROM 402 and RAM 403 illustrated in FIG. 4. The porous body state determining unit instructs the device operation controller to form a test pattern for checking image quality and the image quality detecting device to detect image quality of the test pattern subjected to liquid absorption treatment in the liquid absorbing device, and determines the state of the porous body from detection results obtained in the image quality detecting device.

The image quality detecting device includes a reading unit equipped with a sensor S for optically reading the test pattern. As illustrated in FIG. 1, the sensor S can be provided between the liquid absorbing device and the transfer part to read the test pattern on the transfer body 101. Image data of the read pattern are sent to the RAM 403 to thereby be used as information in the porous body state determining unit. The sensor S may be provided so that the test pattern is printed on the printing medium via the transfer part and the pattern is read in a conveyance path of the printing medium after the transfer part (FIG. 1). Further, a user may view the printed pattern and input the information used by the porous body state determining unit via the operation controller 302.

That is, in the system for determining the state of the porous body, the test pattern for testing image quality is formed as an image, the image quality of the test pattern subjected to a liquid absorbing step is detected by the image quality detecting device, and a porous body checking step of determining the state of the porous body from the obtained detection results is performed.

As the test pattern, it is preferable to use an image pattern capable of detecting the state of the porous body, that is, capable of detecting whether the porous body is in a state in which the liquid absorption function is good, a state in which a decrease in the liquid absorption function can be predicted, or a state in which the liquid absorption function is deteriorated.

For example, when occurrence of the smeared image is used as the basis for determining the state of the porous body, the state of the porous body can be determined by the following process. First, a state of the porous body generating a smeared image is previously investigated using a test pattern having a plurality of images formed by stepwise changing an ink application amount. In investigation using the test pattern as described above, when no smeared image occurs in all the ink application amounts, the porous body is determined to be in a good state. Further, when the smeared image occurs, there is a need to grasp an ink application amount when the smeared image occurs and an ink application amount when the smeared image does not occur in advance. It is possible to check the state of the porous body at appropriate timing during repetitive use of the porous body using the test pattern based on the ink application amount grasped as described above.

Further, it is possible to change formation conditions of the image in the image forming unit depending on the state of the porous body determined in the porous body state determining unit.

In addition, it is possible to provide a porous body processing controller, select processing for the porous body depending on the state of the porous body determined by the porous body state determining unit, and instruct a corresponding device (not illustrated in FIGS. 1 and 4) to perform the selected processing.

As the processing for the porous body, the following processing can be performed.

(I) Notification processing of notifying an exchange timing of the porous body.

(II) Processing of stopping an image forming operation (ink image forming operation).

The processing of (I) can be performed using a system known in the art.

Further, the processing of (II) can be performed by the device operation controller illustrated in FIG. 3. In addition, an air permeability checking step of determining air permeability of the porous body from contact information on the image of the liquid absorbing surface of the porous body of the liquid absorbing member and an intrinsic parameter for the porous body may be performed. A formable image amount (an ink image amount) can be determined based on the determination of the air permeability of the porous body in the air permeability checking step. A more reliable image can be formed by adding determination of the formable image amount in addition to the determination of the state of the porous body using the test pattern described above.

The formable image amount can be determined by a system having the following units.

(i) A contact information memory unit storing contact information including a contact frequency of the liquid absorbing surface of the porous body repeatedly conveyed to the liquid absorption treatment region again by the conveyance device with the image and a contact pressure applied to the liquid absorbing surface of the porous body at each contact.

(ii) An air permeability determining unit determining air permeability of the porous body from the contact information and an intrinsic parameter for the porous body.

(iii) An image amount determining unit (ink image amount determining unit) determining a newly formable image amount from air permeability of the porous body.

The contact information used in determination as described above includes information on the contact frequency of the porous body repeatedly conveyed to the liquid absorption treatment region again with the image (the cumulative contact frequency from the start of use in the same porous body) and the contact pressure applied to the liquid absorbing surface of the porous body at each contact.

As the contact pressure applied to the porous body, a contact pressure of each member coming in contact with the porous body is used. For example, a contact pressure set in the pressing member 105*b* for the liquid absorbing member can be used. These contact pressures may be preliminarily measured and grasped, and when the ink jet printing apparatus adjusts the contact pressure of each member to the porous body, the adjusted contact pressure is recognized by the CPU 401 and can be memorized and used in the ROM 402. Further, as the contact frequency, a value measured by a counter provided in the liquid absorbing device can be used. As contact frequency counter, a counter capable of counting a frequency at which the same portion of the porous body passes through the liquid absorption treatment region may be preferable, but the contact frequency counter is not particularly limited. For example, an encoder detecting rotation of the roller conveying the liquid absorbing member 105*a* can be used. Further, the ASIC 404 may have a counting function and update a count value of a register provided in the ASIC, or the counting function may also be realized by the functions of the CPU 401 and the ROM 402.

The contact information including the contact pressure and the contact frequency at the time of repeatedly using the porous body is stored in the contact information memory unit to thereby be used to determine the air permeability of the porous body. The contact information memory unit can be provided, for example, in the RAM 403 illustrated in FIG. 4.

Here, the ink jet printing apparatus executes various modes such as a startup sequence, a shutdown sequence, normal printing, and maintenance. In each mode, the same combination does not come in contact with the porous body. For example, in the startup sequence of the ink jet printing apparatus, the transfer body 101 and the liquid absorbing member 105*a* do not come in contact with each other, but after necessary startup is performed on each of the transfer body 101 side and the liquid absorbing device 105 side, the transfer body 101 and the liquid absorbing member 105*a* come in contact with each other. At the time of starting-up the liquid absorbing device 105 side, the treatment liquid applying members 103*a* and 103*b*, the holding liquid amount adjusting member 112 and the cleaning member 110*a* for a liquid absorbing member sequentially come in contact with each other. Some of them may come in contact with the liquid absorbing member after the transfer body 101 and the liquid absorbing member 105*a* come into contact with each other. Although the transfer body 101 and the liquid absorbing member 105*a* come in contact with each other at normal printing, in the shutdown sequence of the ink jet printing apparatus, after separating the transfer body 101 and the liquid absorbing member 105*a* from each other, shutdown to be required is performed on each of the transfer body 101 side and the liquid absorbing device 105 side.

In this view, the contact information memory unit recognizes the mode in the ink jet printing apparatus and stores the contact information including the contact pressure and the contact frequency in the contact information memory unit with respect to one or a plurality of members coming in contact with the liquid absorbing member 105*a* in this mode and further in a phase in this mode.

Calculation of a Gurley value using the contact information and the intrinsic parameter for the porous body as an index of the air permeability and determination of the air permeability of the porous body using the Gurley value can be performed by the air permeability determining unit. In the device operation controller illustrated in FIG. 4, the CPU 401 can execute a function of the air permeability determining unit using a determination program installed in the ROM 402. The air permeability determining unit executes determination of air permeability using contact information for each mode or each phase stored in the contact information memory unit.

As the intrinsic parameter for the porous body, it is preferable to use a fitting coefficient calculated by a polynomial equation in which the contact frequency is x, the contact pressure is y, and x and y are variables with respect to air permeability z evaluated by repeatedly applying the contact pressure to the porous body in advance.

Further, the formable image amount can be prescribed and presented depending on a shape or size of the printing medium. For example, in the case of forming a standard image such as A4 and B5, the formable image amount can be presented as the number of sheets of the image capable of being formed.

Meanwhile, the porous body may be exchangeable, intrinsic parameter information of the porous body may be attached for each porous body for exchange, and intrinsic parameter information on the porous body stored in the contact information memory unit may be input from an input unit and be updated whenever the porous body is exchanged. The apparatus may be configured so that input of this parameter can be performed manually or automatically. A reading method in automatic input, that is, information for reading and a form of the reading unit are not particularly limited, and a system known in the art can be used.

(Direct Drawing Type Ink Jet Printing Apparatus)

As another exemplary embodiment of the present invention, there is a direct drawing type ink jet printing apparatus. In the direct drawing type ink jet printing apparatus, an ink receiving medium is a printing medium on which an image is formed.

Figure 2:
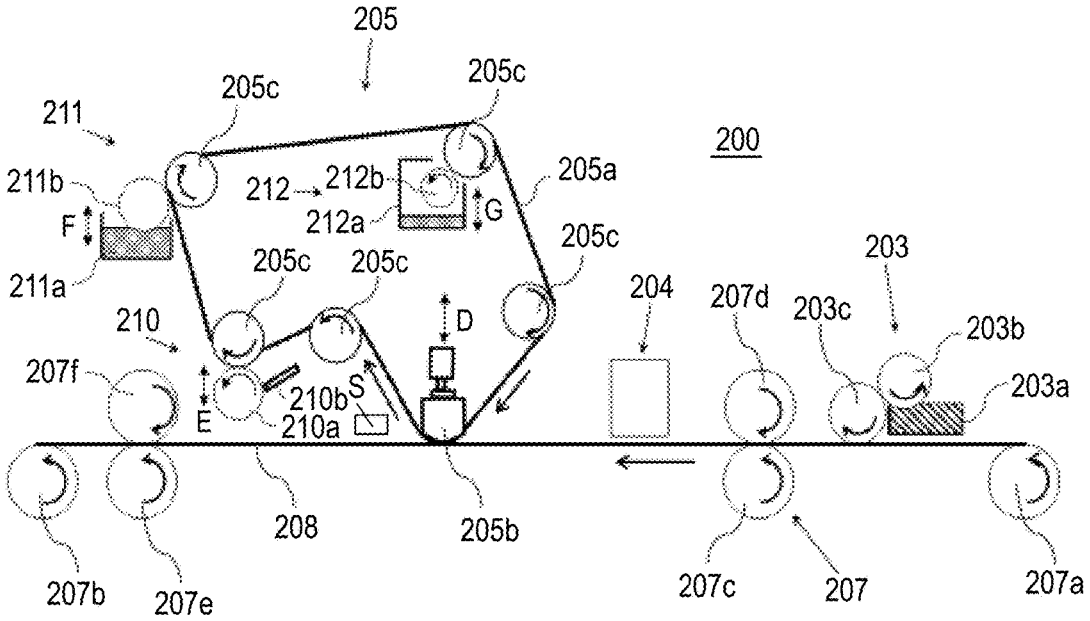
FIG. 2 is a schematic diagram illustrating an example of a configuration of a direct drawing type ink jet printing apparatus according to an exemplary embodiment of the present invention.

FIG. 2 is a schematic diagram illustrating an example of a schematic configuration of the direct drawing type ink jet printing apparatus 200 according to the present exemplary embodiment. As compared with the above-mentioned transfer type ink jet printing apparatus, the direct drawing type ink jet printing apparatus includes units similar to those of the transfer type ink jet printing apparatus except that the transfer body 101, the support member 102, and the cleaning member 109 for a transfer body are not included, and an image is formed on a printing medium 208.

Therefore, a reaction liquid applying device 203 including a reaction liquid storage part 203*a* and reaction liquid applying members 203*b* and 203*c* and an ink applying device 204 have configurations similar to those of the transfer type ink jet printing apparatus, and a description thereof is omitted. Further, similarly, a description of a liquid absorbing device 205 absorbing a liquid component contained in an ink image using a liquid absorbing member 205*a* coming in contact with the ink image on the printing medium 208 is also omitted. Similarly, a description of a cleaning device 210 for a liquid absorbing member, which includes a cleaning member 210*a* for an absorbing member, for removing attached substance from the liquid absorbing member 205*a* and a cleaning blade 210*b* is also omitted. Similarly, a description of a pre-treatment liquid applying device 211 including a pre-treatment liquid storage part 211*a* and a pre-treatment liquid applying member 211*b* and applying a pre-treatment liquid to the liquid absorbing member 205*a* and a holding liquid amount adjusting device 212 including a holding liquid amount adjusting member 212*b* and a holding liquid storage part 212*a* and removing an unnecessary liquid from the liquid absorbing member 205*a* to adjust a holding liquid amount is omitted. Further, in the direct drawing type ink jet printing apparatus according to the present exemplary embodiment, the liquid absorbing device 205 includes the liquid absorbing member 205*a* and a pressing member 205*b* for a liquid absorbing member, for pressing the liquid absorbing member 205*a* against the ink image on the printing medium 208. Further, shapes of the liquid absorbing member 205*a* and the pressing member 205*b* are not particularly limited, but the liquid absorbing member 205*a* and the pressing member 205*b* having shapes similar to those of a liquid absorbing member and a pressing member capable of being used in the transfer type ink jet printing apparatus can be used. Further, the liquid absorbing device 205 may have an extending member extending the liquid absorbing member. In the FIG. 2, an extending roller 205*c* serves as the extending member. The number of extending rollers is not limited to 5 as illustrated in FIG. 4, but a necessary number of extending rollers may be disposed depending on a design of the device. Further, a printing medium support member (not illustrated) supporting the printing medium from below may be provided in an ink applying part applying ink to the printing medium 208 by the ink applying device 204 and a liquid component removing part making the liquid absorbing member 205*a* to come in contact with the ink image on the printing medium to remove the liquid component.

Further, a sensor S for reading the above-mentioned test pattern is provided.

<Printing Medium Conveyance Device>

In the direct drawing type ink jet printing apparatus according to the present exemplary embodiment, a printing medium conveyance device 207 is not particularly limited, and a conveyance unit in a direct drawing type ink jet printing apparatus known in the art can be used. For example, as illustrated in FIG. 2, a printing medium conveyance device including a printing medium conveyance roller 207*a*, a printing medium winding roller 207*b* and printing medium conveyance rollers 207*c* to 207*f* can be used.

<Control System>

In the direct drawing type ink jet printing apparatus according to the present exemplary embodiment, the ink jet printing apparatus has a control system controlling each of the devices. A block diagram illustrating the control system for the entire apparatus in the direct drawing type ink jet printing apparatus illustrated in FIG. 2 is as illustrated in FIG. 3 similarly to the transfer type ink jet printing apparatus illustrated in FIG. 1.

Figure 5:
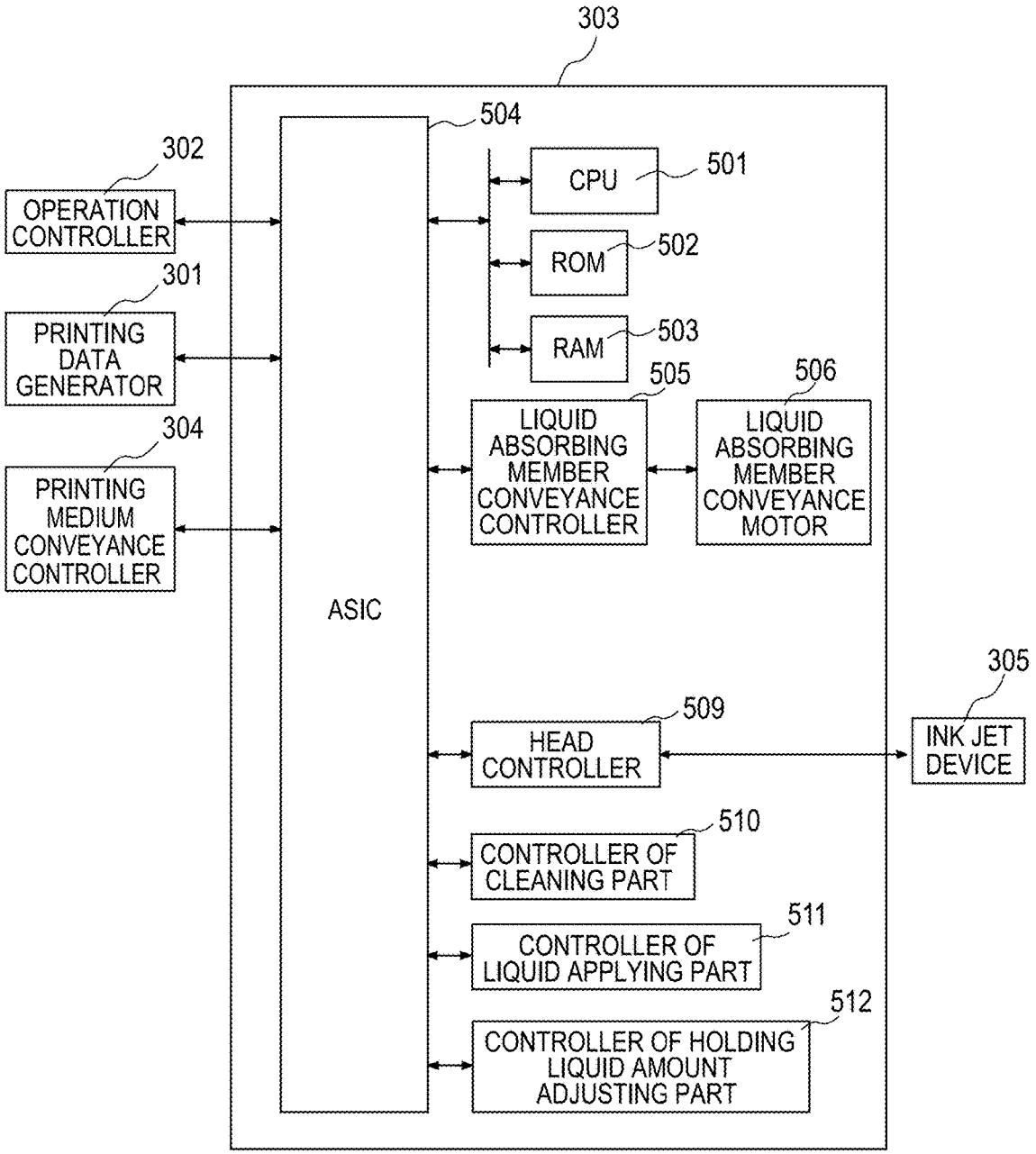
FIG. 5 is a block diagram of a printer controller in the direct drawing type ink jet printing apparatus illustrated in FIG. 2.

FIG. 5 is a block diagram of a printer controller in the direct drawing type ink jet printing apparatus of FIG. 2. The block diagram is the same as the block diagram of the printer controller in the transfer type ink jet printing apparatus in FIG. 4 except that the transfer body driving controller 407 and the transfer body driving motor 408 are not included. That is, a CPU 501 controls the whole printer, a ROM 502 stores a control program for the CPU 501, and a RAM 503 executes a program. An ASIC 504 includes a network controller, a serial IF controller, a controller for generating head data, a motor controller and the like. A liquid absorbing member conveyance controller 505 drives a liquid absorbing member conveyance motor 506, and the liquid absorbing member conveyance controller 505 is controlled by a command from the ASIC 504 via a serial IF. A head controller 509 generates final ejection data of the ink jet device 305 and generates a driving voltage, etc.

A controller 510 of a cleaning part can be used as a lifting controller of the cleaning device for a liquid absorbing member for driving a lifting air cylinder (not illustrated) of the cleaning device for a liquid absorbing member, that is, as a liquid absorbing member cleaning controller. The controller 510 is controlled by a command from the ASIC 504 via a serial IF.

A controller 511 of a liquid applying part can be used as a lifting controller of a recovery liquid applying device for driving a lifting air cylinder (not illustrated) of the recovery liquid applying device, that is, as a recovery liquid application controller. The controller 511 is controlled by a command from the ASIC 504 via a serial IF. A controller 512 of a holding liquid amount adjusting part can be used as a lifting controller of a holding liquid amount adjusting device for driving a lifting air cylinder (not illustrated) of the holding liquid amount adjusting device, that is, as a holding liquid amount adjustment controller. The controller 512 is controlled by a command from the ASIC 504 via a serial IF.

<Change in Characteristics of Liquid Absorbing Member by Contact Pressure>

First, the fitting coefficient that can be preferably used in determining the formable ink image amount is described below.

When a contact pressure is applied to a liquid absorbing member composed of a porous body, compression deformation by the contact pressure occurs. When the contact pressure is released, deformation is recovered to a state before the contact, but a permanent set remains due to continuously repeated application of the contact pressure, which causes distortion of the porous body and deteriorates air permeability.

Figure 6:
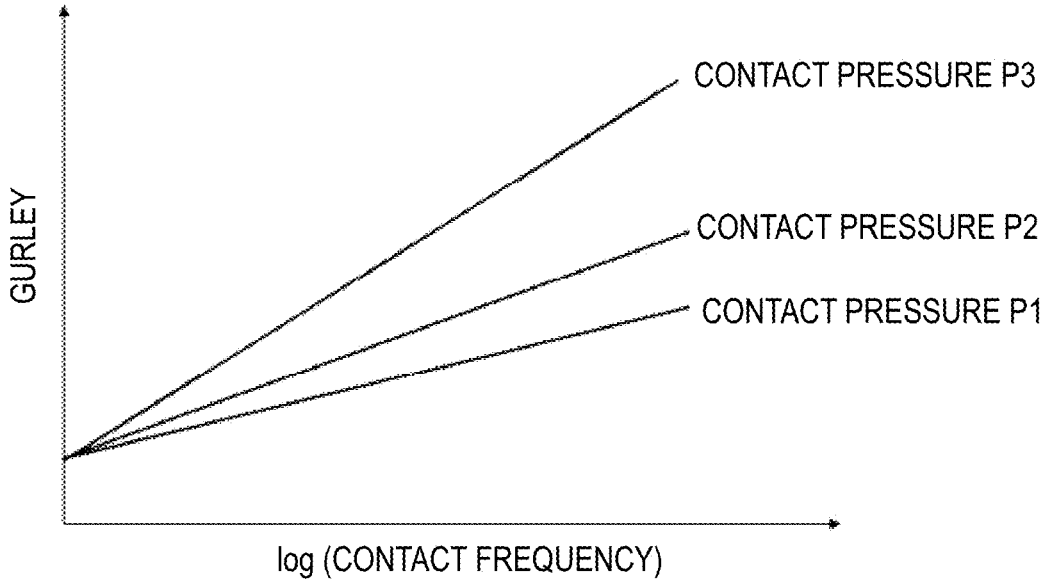
FIG. 6 is a graph illustrating a relationship between a contact frequency and a Gurley value when a contact pressure is applied to a porous body.

FIG. 6 is a graph illustrating a relationship between a contact pressure, a contact frequency and a Gurley value of a porous body corresponding to an index of air permeability when a contact pressure is repeatedly applied to the porous body. A change in the Gurley value showed a linear relationship with respect to a logarithm of the contact frequency, and it was found that the higher the contact pressure, the higher the increase rate of the Gurley value (P1<P2<P3).

When the contact frequency is x, the contact pressure is y, and the Gurley value of the porous body is z, the contact pressure, the contact frequency, and the Gurley value can be expressed by the following Correlation Equation.

$$z=a\cdot\log(x)+b\cdot y+c\ \log(x)\cdot y+d: \qquad \text{Equation (1)}$$

Here, a, b, c and d are coefficients and intrinsic parameters for each porous body. The intrinsic parameter can be determined by fitting a change in Gurley value at the time of repeatedly applying different contact pressures to the porous body in advance with Equation (1).

If the intrinsic parameter and the contact pressure applied during one revolution of the liquid absorbing member 105*a* are known, the increase amount in the Gurley value due to the contact can be calculated. A Gurley value of the porous body of the liquid absorbing member 105*a* at a certain time point t is represented by z(t). When the contact pressure applied to the liquid absorbing member by the pressing member 105*b* for the liquid absorbing member is $P_A$ and the contact pressure by the treatment liquid applying device 10 is $P_B$, a Gurley value z(t+1) of the liquid absorbing member 105*a* after one revolution is represented by the following Equation (2):

$$\begin{aligned} z(t+1) = & \qquad \text{Equation (2).} \\ & z(t)+a\cdot\log(x_A(t+1))+b\cdot P_A+c\log(x_A(t+1))\cdot P_A+ \\ & d-(a\cdot\log(x_A(t))+b\cdot P_A+c\log(x_A(t))\cdot P_A+d)+ \\ & a\cdot\log(x_B(t+1))+b\cdot P_B+c\log(x_B(t+1))\cdot P_B+ \\ & d-(a\cdot\log(x_B(t))+b\cdot P_A+c\log(x_B(t))\cdot P_B+d)= \\ & z(t)+(a+c\cdot P_A)\cdot\log(x_A(t+1)/x_A(t))+ \\ & (a+c\cdot P_B)\cdot\log(x_B(t+1)/x_B(t))= \\ & z(t)+(a+c\cdot P_A)\cdot\log((x_A(t)+1)/x_A(t))+ \\ & (a+c\cdot P_B)\cdot\log((x_B(t)+1)/x_B(t)): \end{aligned}$$

Here, $x_A(t)$ and $x_B(t)$ are obtained from Equation (1) as follows:

$$x_A(t)=10\hat{}\{(z(t)-b\cdot P_A-d)/(a+c\cdot P_A)\}: \qquad \text{Equation(3A) and}$$

$$x_B(t)=10\hat{}\{(z(t)-b\cdot P_B-d)/(a+c\cdot P_B)\}: \qquad \text{Equation(3B).}$$

By using the above-mentioned relationship, it is possible to count the contact pressure applied to the liquid absorbing member 105*a* and the contact frequency and predict a Gurley value of the porous body by Equation (2), such that the Gurley value is used to treat the liquid absorbing member as an index of air permeability of the porous body. Further, although a configuration in which the number of contact portions is two is described here, even in the case in which a cleaning mechanism by a contact member or a holding liquid amount adjusting mechanism, etc. is additionally provided, it is possible to predict the Gurley value of the porous body by similarly using the above-mentioned Correlation Equation.

In addition, although the Gurley value is represented by Equation (1) in the present invention, but the Gurley value may be based on another Equation as long as the Equation can well express features of a change in Gurley value.

<Evaluation of Smeared Image and Test Pattern>

Figure 7:
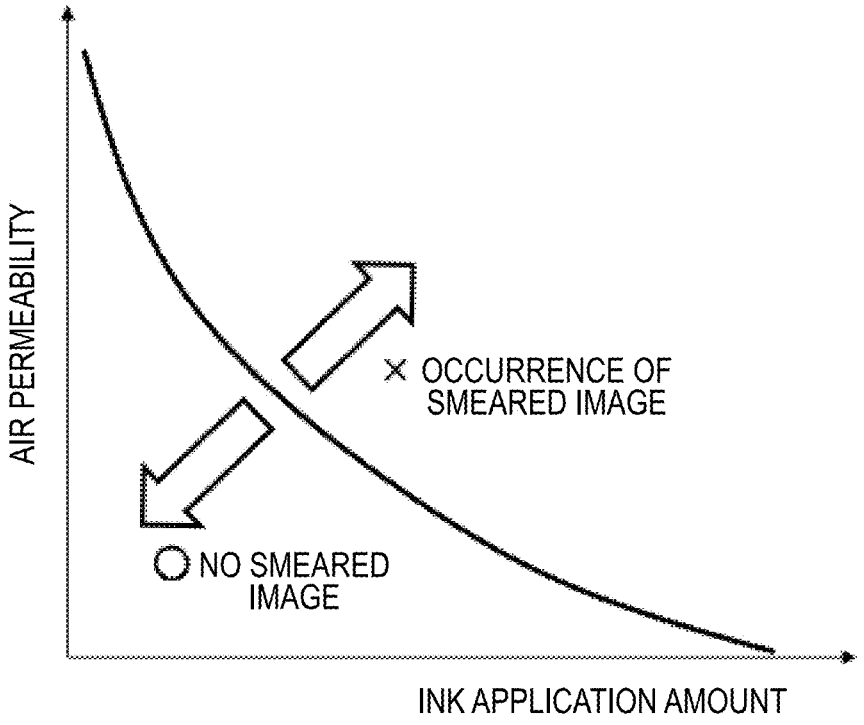
FIG. 7 is a graph illustrating a relationship between an ink application amount and air permeability of the porous body with respect to a smeared image.

FIG. 7 is a graph illustrating a relationship between an ink application amount and air permeability of the porous body in a smeared image. When the liquid is removed from the ink image by the liquid absorbing member, as the lower the air permeability of the porous body, the easier the smeared image occurs. Further, the larger the ink application amount of the image, the easier the smeared image occurs. A liquid absorbing step is established on a balance between an action of sweeping the ink image away due to the contact pressure at the liquid absorbing member and an action of absorbing the liquid to increase the viscosity of the ink so that it is difficult to cause deformation of the image. Therefore, the smeared image is caused in relation to the air permeability of the porous body and the ink application amount of the image.

Figure 8A:
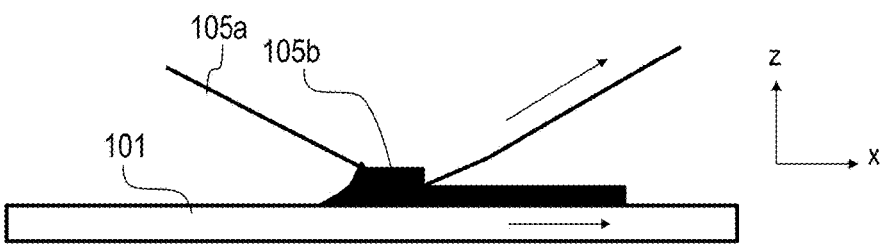
FIGS. 8A, 8B and 8C are schematic diagrams illustrating a smeared image.
Figure 8B:
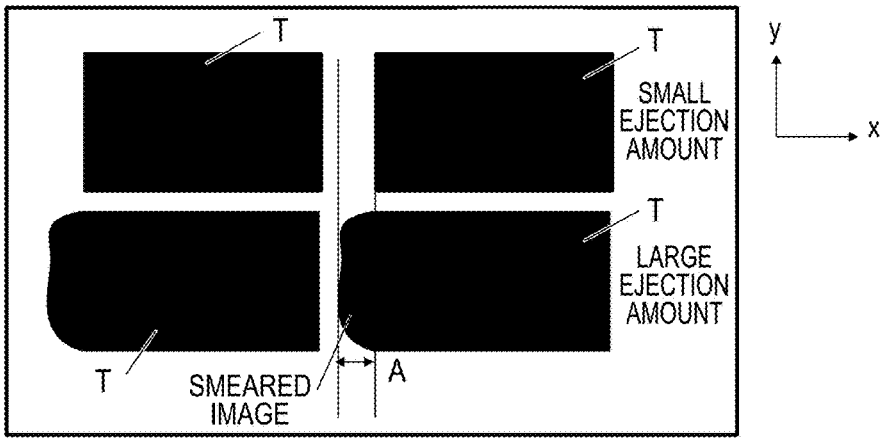
Figure 8C:
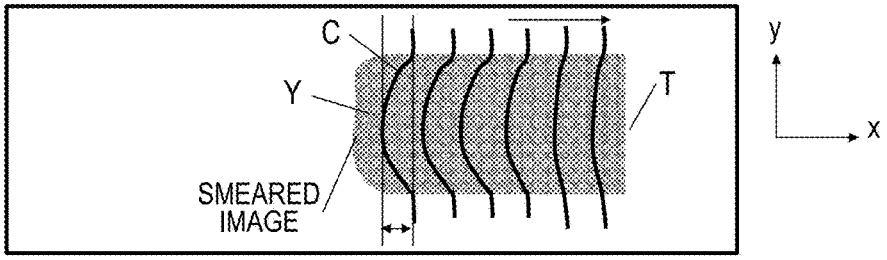

FIGS. 8A to 8C are schematic diagrams of test patterns for detecting appearance of the smeared image and a state of the liquid absorbing member 105*a*, and illustrate a form in which the test pattern is formed on the transfer body 101.

In the test pattern illustrated in FIG. 8B, two patterns T with a small ejection amount are arranged in an X direction in an upper portion and two patterns T with a large ejection amount are arranged in the X direction in a lower portion. The small ejection amount indicates a pattern with a small ink application amount around an area, and the large ejection amount indicates a pattern with a larger ink application amount around the area. Besides, patterns may be arranged in a Y direction by making the ink application amount different in multiple stages.

FIG. 8A is a schematic diagram illustrating a phenomenon of the smeared image. When a liquid absorption speed in the liquid absorbing member 105*a* is slow or the ink application amount is large, the ink image (black portion) on the transfer body 101 tends to be swept away toward an upstream side in the conveyance direction of the transfer body 101, which leads to image disturbance. Although a smeared image is easy to confirm at an end portion of a solid image, movement is also occurring inside the image other than the end portion, and if a movement amount due to the smeared image is generated by about 20 μm or more corresponding to a human visual recognition limit, it is easy to recognize the smeared image. It can be confirmed that the smeared image is occurring in the above-mentioned test pattern with a large ejection amount.

In FIG. 8B, a line A is a position of a left end of the ink image before contact with the liquid absorbing member 105*a*. A length (indicated by an arrow) from this position to the left end of the ink image after contact with the liquid absorbing member 105*a* is different depending on a degree of the smeared image. Therefore, if it is possible to recognize a change in a position of an end portion in an upstream side of the test pattern in the movement direction of the liquid absorbing member 105*a* before and after the contact with the liquid absorbing member 105*a*, the smeared image can be evaluated using the test pattern.

For example, it becomes easy to grasp a current state by comparing the degree of the smeared image of the pattern T for each ejection amount. It is preferable that a threshold ejection amount is set and the user can know the timing at which the smeared image is recognized by the ejection amount as the exchange timing.

Further, it is also possible to obtain a Gurley value by recognizing the position of the end portion of the test pattern in the upstream side in the movement direction of the liquid absorbing member 105*a* and measuring a distance between the recognized position and a reference. Here, the reference may be a right end (a position of an end portion of the test pattern in a downstream side in the movement direction of the liquid absorbing member 105*a*) of the ink image before or after contact with the liquid absorbing member 105*a*.

Alternatively, the reference may be the position of A in FIG. 8B. When the ink image is read by the image quality detecting device, the position of A corresponding to the reference can be easily recognized by analyzing obtained image data.

In addition, the smeared image can be evaluated by using test patterns of two colors as illustrated in FIG. 8C. The test pattern T in FIG. 8C is formed by a combination of a uniform pattern (code Y) by yellow ink and a line pattern (code C) by cyan ink applied thereon. Since a cyan ink application amount per unit area is set to be slightly small, no smeared image is observed in the test pattern outside a region of yellow ink, and this position is the reference position A. Since a width (arrow in FIG. 8C) of a line of C swept away toward the upstream side in the X direction reflects an amount of the smeared image, the degree of the smeared image can be evaluated with this width. To form an upper line pattern with ink having lower brightness than that of the ink forming a lower solid pattern is preferable in that it is easy to recognize a movement amount of the line pattern in both visual recognition by the user and detection by an optical device. A cause of the smeared image is a balance between the liquid absorption characteristic of the porous body and resistance as external force determined by the cohesive force of the ink image, but the threshold as to whether or not the smeared image occurs is changed depending on various conditions. For example, when a conveyance speed of the transfer body 101 is fast, a temporal change in pressure profile of a nip portion between the liquid absorbing member 105*a* and the transfer body is increased, and the image is swept away before the liquid is sufficiently absorbed. In addition, when the pressing force of the pressing member 105*b* for the liquid absorbing member with respect to the transfer body is large, similarly, the temporal change of the pressure profile becomes large, and the smeared image easily occurs. In addition, since the cohesive force of the ink changes depending on plasticity of the material constituting the ink or the reaction liquid, an ink temperature at the time of absorbing the liquid, etc., the degree of occurrence of the smeared image changes.

In consideration of the above state, by grasping the threshold at which the smeared image occurs in advance under the condition of operating the apparatus, air permeability of the porous body predicted in the present invention is compared with the threshold at which the smeared image occurs, thereby making it possible to cope appropriately before the smeared image occurs.

Example

Hereinafter, the present exemplary embodiment is described in more detail using Examples and Comparative Examples. The present invention is not limited by the following Examples without departing from the gist of the present invention. Further, in the description of the following Examples, unless otherwise specified, the term "part" is based on mass.

Example 1

In the present Example, the transfer type ink jet printing apparatus illustrated in FIG. 1 was used.

A transfer body 101 in the present Example was fixed to a support member 102 by an adhesive.

In the present Example, a sheet in which a PET sheet having a thickness of 0.5 mm was coated with silicone rubber (trade name: KE12, manufactured by Shin-Etsu Chemical Co., Ltd.) at a thickness of 0.3 mm was used as an elastic layer of the transfer body. Further, as a heat insulating layer of the support member 102 and the elastic layer, foamable silicone rubber containing bubbles and having a thickness of 0.5 mm was used below the elastic layer. Further, a mixture of a condensate obtained by mixing glycidoxypropyltriethoxysilane and methyltriethoxysilane with each other at a molar ratio of 1:1 and heating the mixture under reflux and a photo cationic polymerization initiator (trade name: SP150, manufactured by ADEKA) was prepared. Atmospheric pressure plasma treatment was performed so that a contact angle of water on a surface of the elastic layer was 10 degrees or less, the mixture was applied onto the elastic layer, and UV irradiation (high-pressure mercury lamp, integrated exposure amount: 5000 mJ/cm$^2$) and heat-curing (at 150° C. for 2 hours) were performed thereon to form a film, thereby manufacturing a transfer body 101 in which a surface layer having a thickness of 0.5 μm was formed on the elastic layer.

In this configuration, although not illustrated for simplicity of explanation, a double-sided tape was used between the transfer body 101 and the support member 102 in order to hold the transfer body 101. In addition, a double-sided tape was also used between the elastic layer of the transfer body 101 and the heat insulating layer in order to hold the elastic layer.

As a reaction liquid applied by a reaction liquid applying device 103, a reaction liquid having the following composition was used, and an application amount was 1 g/m$^2$.

Levulinic acid: 40.0 parts
Glycerin: 5.0 parts
Megaface F444 (trade name): 1.0 part (surfactant, manufactured by DIC)
Ion exchange water: 54.0 parts Ink was prepared as follows.

<Preparation of Ink>

<Preparation of Resin Particle>

A 4-necked flask equipped with a stirrer, a reflux condenser and a nitrogen gas introducing tube was charged with 18.0 parts of butyl methacrylate, 2 parts of a polymerization initiator (2,2'-azobis(2-methylbutyronitrile)) and 2.0 parts of n-hexadecane, and a nitrogen gas was introduced into a reaction system, followed by stirring for 0.5 hours. After 78.0 parts of a 6.0% aqueous solution of an emulsifier (trade name: NIKKOL B C15, manufactured by Nikko Chemicals Co., Ltd.) were dropped into the flask, the mixture was stirred for 0.5 hours. Next, the mixture was emulsified by irradiating ultrasonic waves for 3 hours using an ultrasonic irradiator. Thereafter, a polymerization reaction was carried out at 80° C. for 4 hours under a nitrogen atmosphere. After the reaction system was cooled to 25° C., components were filtered, and a suitable amount of pure water was added thereto, thereby preparing a water dispersion of a resin particle 1 in which a content (solid content) of the resin particle 1 was 20.0%.

<Preparation of Aqueous Solution of Resin>

A styrene-ethyl acrylate-acrylic acid copolymer (resin 1) having an acid value of 150 mgKOH/g and a weight average molecular weight of 8,000 was prepared. An aqueous solution of the resin 1 in which a content (solid content) of the resin was 20.0% was prepared by neutralizing 20.0 parts of the resin 1 with potassium hydroxide in a molar amount equivalent to an acid value and adding a suitable amount of pure water.

(Preparation of Pigment Dispersion)

First, 10.0 parts of a pigment (carbon black), 15.0 parts of the aqueous solution of the resin 1 and 75.0 parts of pure water were mixed with each other. The mixture and 200 parts of zirconia beads having a diameter of 0.3 mm were placed in a batch type vertical sand mill (manufactured by AIMEX Co., Ltd.) and dispersed for 5 hours while cooling with water. Thereafter, coarse particles were removed by centrifugation, and the resultant was subjected to pressure-filtration with a cellulose acetate filter (manufactured by Advantec) having a pore size of 3.0 μm, thereby preparing a pigment dispersion K in which a content of the pigment was 10.0% and a content of a resin dispersant (resin 1) was 3.0%.

(Preparation of Ink)

After the following components were mixed and sufficiently stirred, respectively, pressure-filtration was performed thereon with a cellulose acetate filter (manufactured by Advantec) having a pore size of 3.0 μm, thereby preparing each ink. Acetylenol E100 is a surfactant manufactured by Kawaken Fine Chemicals Co., Ltd.

(Composition of Ink)

Pigment dispersion K: 20.0 mass %

Water dispersion of resin particle 1: 50.0 mass %

Aqueous solution of Resin 1: 5.0 mass %

Glycerin: 5.0 mass %

Diethylene glycol: 7.0 mass %

Acetylenol E100: 0.5 mass % pure water: 12.5 mass %

As an ink applying device 104, an ink jet device having an on-demand type ink jet head performing ink ejection in an on-demand manner using an electro-thermal converter was used, and an ink application amount was 20 g/m$^2$.

<Liquid Absorbing Member>

As a liquid absorbing member, a laminate of three layers of porous bodies was used. Porous PTFE having an average pore diameter of 0.3 μm was used in a first layer coming in contact with an ink image. As a first support layer, a porous film made of polyolefin was used. Further, as a second support layer, a porous film made of polyphenyl sulfide was used. These layers were laminated by heating to thereby be used as the liquid absorbing member. This liquid absorbing member was dipped in a treatment liquid consisting of 95 parts of ethanol and 5 parts of water, allowed to permeate, then replaced with a liquid consisting of 100 parts of water and then used for liquid removal. Further, as a pressing member 105*b* in a liquid absorbing unit, a roller having a roller diameter φ of 200 mm was used.

The liquid absorbing member 105*a* was adjusted by conveyance rollers 105*c*, 105*d* and 105*e* conveying the liquid absorbing member while extending the liquid absorbing member so as to have a speed equal to a movement speed of the transfer body 101. Further, a printing medium 108 was conveyed by a printing medium conveyance roller 107*a* and a printing medium winding roller 107*b* so as to have a speed equal to the movement speed of the transfer body 101. In the present Example, a conveyance speed was 0.6 m/s, and as the printing medium 108, aurora coating paper (trade name, manufactured by Nippon Paper Industries Co., Ltd., basis weight: 104 g/m$^2$) was used.

Image quality deterioration due to a smeared image can be prevented in advance by printing a test pattern for checking image quality, including regions with different ink application amounts. In a configuration of the present Example, under the condition at which the ink application amount was 20 g/m$^2$, when a Gurley value of the porous body was more than 8 seconds, a smeared image occurred. Further, it could be appreciated that under the condition at which the ink application amount was 25 g/m$^2$, when a Gurley value of the porous body was more than 7.5 seconds, a smeared image occurred. Further, this test pattern had an image pattern capable of checking the occurrence of the smeared image.

The smeared image was evaluated using an image sensor, and the presence or absence of the smeared image was determined by comparing input image data and an actually printed ink image with each other. In a transfer type ink jet printing apparatus which forms an image on a transfer body and then undergoes a liquid removal step and a transfer step to a printing medium, evaluation may be performed on the transfer body after the liquid removal step, or on the image after being transferred onto the printing medium. Further, in a direct drawing type ink jet printing apparatus that does not use a transfer body, it is preferable to perform evaluation on a printing medium on which an image has been formed. In addition, instead of using an image sensor, evaluation may be performed by visual recognition by an operator.

Based on the above relationship, in a state in which no smeared image occurred in the test pattern for checking image quality, including an image with an ink application amount of 25 g/m$^2$, an arbitrary image with a maximum ink application amount of 25 g/m$^2$ was printed. When the smeared image started to occur in the region where the ink application amount was 25 g/m$^2$ due to deterioration of the liquid absorbing member, a printed image was limited to an image of which the maximum ink application amount was less than 25 g/m$^2$. Limitation of the printed image may be automatically performed based on the maximum ink application amount of data on an image waiting to be printed, stored in a memory. Alternatively, a user may be notified of a risk of occurrence of the smeared image and select an image with an ink application amount at which the smeared image did not occur. Further, it was more preferable to give the user a sign prompting exchange of the liquid absorbing member when the smeared image occurs. The sign to the user was made by lighting a notifying lamp (not illustrated) mounted on the ink jet printing apparatus.

Example 2

A basic configuration and operations in the present Example were the same as those in Example 1.

Figure 9:
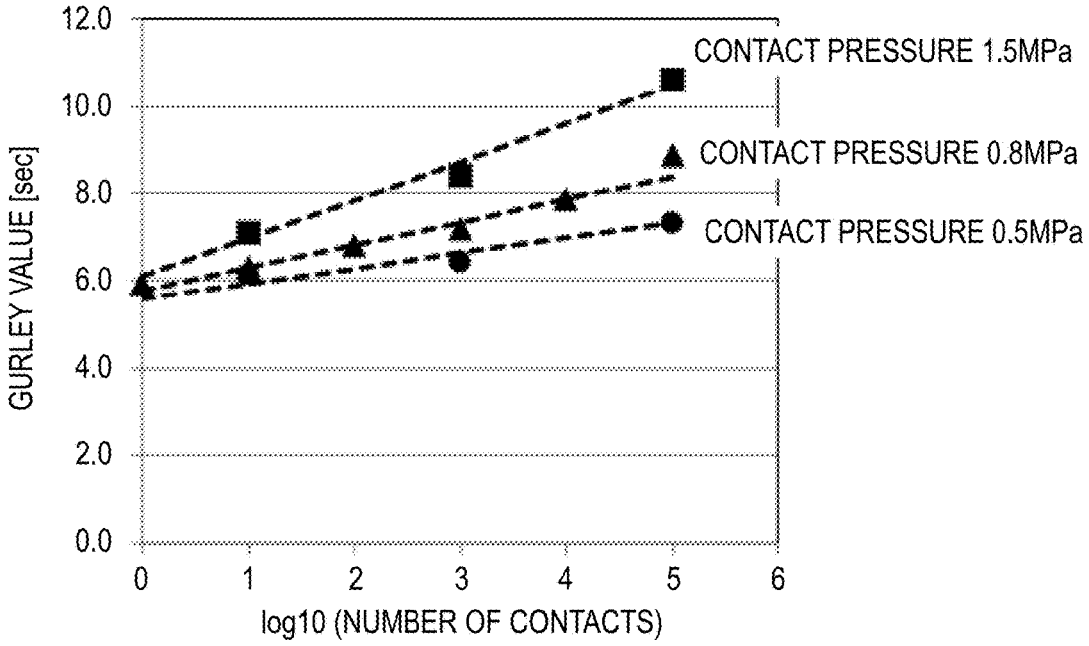
FIG. 9 is a graph illustrating a relationship between a contact frequency and a Gurley value when a contact pressure is applied to a porous body.

FIG. 9 is a graph illustrating measurement results (measurement values indicated at the positions of respective symbols ■, ▲ and •) of a Gurley value when repetitive pressure was applied to a porous body of an liquid absorbing member 105*a* used in the present Example and a fitting curve (broken line) according to Equation (1). A contact pressure (maximum peak pressure) was at three levels of about 0.5 MPa, 0.8 MPa and 1.5 MPa, and FIG. 9 illustrates a change state in the Gurley value up to a contact frequency of 10000 times. Intrinsic parameters of the porous body determined by fitting in Equation (1) were as follows: a=0.060, b=0.512, c=0.575 and d=5.35.

A nip contact pressure (maximum peak pressure) between the transfer body 101 and the liquid absorbing member 105*a* was 0.75 MPa. A nip contact pressure (maximum peak pressure) between a cleaning member 110*a* for a liquid absorbing member and the liquid absorbing member 105*a* was 0.15 MPa. In a treatment liquid applying device 111, a contact pressure (maximum peak pressure) of 0.15 MPa was applied between an offset roller 111*b* and the liquid absorbing member 105*a*. A nip contact pressure (maximum peak pressure) between a holding liquid amount adjusting member 112*b* and the liquid absorbing member 105*a* was 0.45 MPa.

Figure 10:
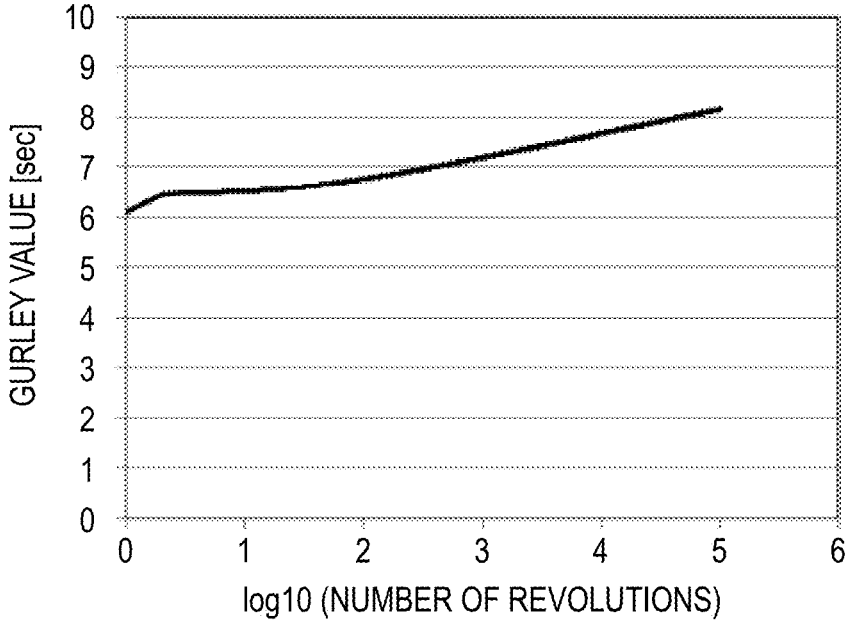
FIG. 10 is a graph illustrating a relationship between the number of revolutions and a Gurley value of a porous body in Example 2.

Changes in Gurley value calculated in consideration of the intrinsic parameters a, b, c and d of the porous body, the contact pressure and the contact frequency are illustrated in FIG. 10. A horizontal axis represents the number of revolutions of the liquid absorbing member 105*a*. It could be appreciated that although an initial Gurley value of the liquid absorbing member 105*a* was 5.2 seconds, after the liquid absorbing member rotated 100,000 times, the Gurley value was increased to about 8.1 seconds due to the contact with the liquid absorbing member 105*a* and the cleaning member 110*a* for the liquid absorbing member, the offset roller 111*b* and the holding liquid amount adjusting member 112*b*.

Meanwhile, according to separate preliminary examination, it could be appreciated that in a combination of the liquid absorbing member, the ink or the like, used in this Example, from when the Gurley value of the liquid absorbing member 105*a* exceeded 8 seconds, the smeared image was significantly viewed to an extent to which the smeared image can be visually recognized as an image defect.

From the above-mentioned results, the Gurley value of the liquid absorbing member 105*a* needs to be 8 seconds or less in order to prevent an image defect due to a smeared image. In the present Example, a predicted Gurley value of 7.5 seconds was set as a threshold value, and when the threshold value was exceeded, the notification lamp for the liquid absorbing member was turned on and a user received a sign to prompt exchange of the liquid absorbing member 105*a*, such that it is possible to prevent the smeared image from occurring in advance.

Further, in addition to the notification lamp, as a notification method, a liquid crystal monitor for notification may be provided, and a notification sign may be displayed thereon. A predicted number of sheets from Gurley value prediction to the time exceeding 7 seconds was displayed, thereby urging the user to exchange the liquid absorbing member before the smeared image occurred.

In addition, in order to prevent printing of an image with poor image quality, the printing operation may be stopped and an operation controller or the like may be used to notify the time of exchange.

Further, in the present invention, since air permeability is predicted from the contact information given to the liquid absorbing member, air permeability can be accurately predicted even under a pressure application condition different from that in normal printing, such as a startup sequence and a shutdown sequence of the apparatus. Since in the startup and shutdown sequences, the transfer body 101 and the nip of the liquid absorbing member 105*a* are released, contact information during this period is not counted. In addition, even in other modes at the time of maintenance, it is possible to predict accurate air permeability by counting the contact information in consideration of pressure applying conditions.

Example 3

A basic configuration and operations in the present Example were the same as those in Example 1.

A liquid absorbing member 105*a* was exchangeable, and an intrinsic parameter for predicting a Gurley value was attached to the liquid absorbing member. As an attachment method, the intrinsic parameter may be written on a storage container receiving the liquid absorbing member or may be directly written on the liquid absorbing member.

At the time of newly exchanging the liquid absorbing member, an intrinsic parameter is input to a main body of the apparatus and the contact information up to that point is reset.

By the methods described above, occurrence of a smeared image can be prevented in advance and printing of a defective image in which the smeared image has occurred can be prevented in advance.

According to the present invention, the ink jet printing method and the ink jet printing apparatus capable of determining a change in state of the porous body to perform suitable processing depending on the state of the porous body even in the case of repeatedly using the porous body to absorb the liquid component from the image by the reaction liquid for thickening the ink and the ink can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131558, filed Jul. 4, 2017, which is hereby incorporated by reference herein in its entirety.

What is claimed is:

1. An ink jet printing method comprising:

an ink image forming step of forming an ink image containing an aqueous liquid component and a coloring material, by applying a reaction liquid for thickening ink and ink containing an aqueous liquid medium and the coloring material onto an ink receiving medium;

a liquid absorbing step of performing a liquid absorption treatment in which the aqueous liquid component is at least partially absorbed from the ink image by a porous body of a liquid absorbing member, by contacting a liquid absorbing surface of the porous body of the liquid absorbing member with the ink image in a liquid absorption treatment region;

a conveying step of conveying the porous body, conveyed from the liquid absorption treatment region, to the liquid absorption treatment region again; and a porous body checking step of forming a test pattern for testing image quality, detecting an image quality of the test pattern, subjected to the liquid absorbing step, by an image quality detecting device, and determining a state of the porous body from the obtained detection results.

2. The ink jet printing method according to claim 1, further comprising a step of changing formation conditions of the ink image depending on the state of the porous body determined from the detection results of image quality.

3. The ink jet printing method according to claim 2, wherein processing on the porous body is notification processing of notifying an exchange timing of the porous body.

4. The ink jet printing method according to claim 2, wherein processing on the porous body is to stop an ink image forming operation on the ink receiving medium.

5. The ink jet printing method according to claim 1, further comprising a porous body processing step of processing the porous body depending on the state of the porous body determined in the porous body checking step.

6. The ink jet printing method according to claim 1, further comprising:

a contact information memory step of storing contact information including a contact frequency of the liquid absorbing surface of the porous body, repeatedly conveyed to the liquid absorption treatment region again by the conveying step, with the ink image and a contact pressure applied to the liquid absorbing surface of the porous body at each contact in a contact information memory unit;

an air permeability checking step of determining air permeability of the porous body from the contact information and an intrinsic parameter for the porous body; and an ink image amount determining step of determining a newly formable ink image amount from the air permeability of the porous body.

7. The ink jet printing method according to claim 4, wherein the intrinsic parameter for the porous body is a fitting coefficient calculated by a polynomial equation in which the contact frequency is x, the contact pressure is y, and x and y are variables with respect to air permeability z evaluated by repeatedly applying the contact pressure to the porous body in advance.

8. The ink jet printing method according to claim 1, wherein the porous body is exchangeable, intrinsic parameter information of the porous body is attached, for each porous body for exchange, to the porous body, and intrinsic parameter information of the porous body stored in a contact information memory unit is updated whenever the porous body is exchanged.

9. The ink jet printing method according to claim 1, wherein the ink receiving medium is a transfer body temporarily maintaining the ink image, and the ink image is transferred from the transfer body onto a printing medium for forming a final image.

10. The ink jet printing method according to claim 1, wherein the ink receiving medium is a printing medium for forming a final image, and the ink image is formed on the printing medium.

11. An ink jet printing apparatus comprising:

an ink image forming unit configured to apply a reaction liquid for thickening ink and ink containing an aqueous liquid medium and a coloring material onto an ink receiving medium to form an ink image containing an aqueous liquid component and the coloring material;

a liquid absorbing device including a liquid absorbing member having a porous body at least partially absorbing the aqueous liquid component from the ink image through a liquid absorbing surface thereof coming into contact with the ink image in a liquid absorption treatment region;

a conveyance device configured to convey the porous body, conveyed from the liquid absorption treatment region, to the liquid absorption treatment region again;

a device operation controller configured to control operations of the ink image forming unit, the liquid absorbing device, and the conveyance device;

an image quality detecting device configured to detect an image quality of the ink image subjected to liquid absorption treatment in the liquid absorbing device; and a porous body state determining unit configured to instruct the device operation controller to form a test pattern for checking the image quality and the image quality detecting device to detect the image quality of the test pattern subjected to liquid absorption treatment in the liquid absorbing device, and to determine a state of the porous body from detection results obtained in the image quality detecting device.

12. The ink jet printing apparatus according to claim 11, wherein in the device operation controller, formation conditions of the ink image can be changed depending on the state of the porous body determined from the detection results of the image quality.

13. The ink jet printing apparatus according to claim 11, further comprising a porous body processing controller configured to select and to instruct processing on the porous body depending on the state of the porous body determined by the porous body state determining unit.

14. The ink jet printing apparatus according to claim 13, wherein processing on the porous body is notification processing of notifying an exchange timing of the porous body.

15. The ink jet printing apparatus according to claim 13, wherein processing on the porous body is to stop an ink image forming operation on the ink receiving medium.

16. The ink jet printing apparatus according to claim 11, further comprising:

a contact information memory unit configured to store contact information including a contact frequency of the liquid absorbing surface of the porous body, repeatedly conveyed to the liquid absorption treatment region again by the conveyance device, with the ink image and a contact pressure applied to the liquid absorbing surface of the porous body at each contact;

an air permeability determining unit configured to determine air permeability of the porous body from the contact information and an intrinsic parameter for the porous body; and an ink image amount determining unit configured to determine a newly formable ink image amount from air permeability of the porous body.

17. The ink jet printing apparatus according to claim 16, wherein the intrinsic parameter for the porous body is a fitting coefficient calculated by a polynomial equation in which the contact frequency is x, the contact pressure is y, and x and y are variables with respect to air permeability z evaluated by repeatedly applying the contact pressure to the porous body in advance.

18. The ink jet printing apparatus according to claim 14, wherein the porous body is exchangeable, intrinsic parameter information of the porous body is attached, for each porous body for exchange, to the porous body, and the ink jet printing apparatus further comprises a parameter input unit configured to update the intrinsic parameter information of the porous body stored in a contact information memory unit whenever the porous body is exchanged.

19. The ink jet printing apparatus according to claim 11, wherein the ink receiving medium is a transfer body temporarily maintaining the ink image, and the ink jet printing apparatus further comprises a transfer unit configured to transfer the ink image, subjected to liquid absorption treatment in the liquid absorbing device, onto a printing medium to form a final image.

20. The ink jet printing apparatus according to claim 11, wherein the ink receiving medium is a printing medium for forming a final image, and the ink image is formed on the printing medium.

21. An ink jet printing apparatus comprising:

an ink image forming unit configured to apply a reaction liquid for thickening ink and ink containing an aqueous liquid medium and a coloring material onto an ink receiving medium to form an ink image containing an aqueous liquid component and the coloring material;

a liquid absorbing device including a liquid absorbing member having a porous body at least partially absorbing the aqueous liquid component from the ink image through a liquid absorbing surface thereof coming into contact with the ink image to concentrate the ink forming the ink image in a liquid absorption treatment region;

a conveyance device configured to convey the porous body conveyed from the liquid absorption treatment region to the liquid absorption treatment region again;

a device operation controller configured to control operations of the ink image forming unit, the liquid absorbing device, and the conveyance device;

an image quality detecting device configured to detect an image quality of the ink image, subjected to liquid absorption treatment in the liquid absorbing device; and a porous body state determining unit configured to instruct the device operation controller to form a test pattern for checking the image quality and the image quality detecting device to detect the image quality of the test pattern subjected to the liquid absorption treatment in the liquid absorbing device, and to determine a state of the porous body from detection results obtained in the image quality detecting device.

* * * * *